US006348302B1

(12) United States Patent
Kosugi

(10) Patent No.: US 6,348,302 B1
(45) Date of Patent: Feb. 19, 2002

(54) IMAGE FORMING METHOD

(75) Inventor: Takuji Kosugi, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/615,957

(22) Filed: Jul. 13, 2000

(30) Foreign Application Priority Data

Jul. 13, 1999 (JP) ..... 11-199678

(51) Int. Cl.[7] ..... G03C 5/16; G03C 7/30; G03C 1/08

(52) U.S. Cl. ..... 430/350; 430/363; 430/380; 430/383; 430/385; 430/391; 430/505; 430/604; 430/944; 430/945

(58) Field of Search ..... 430/350, 264, 430/505, 604, 383, 567, 380, 385, 391, 945, 363, 944

(56) References Cited

U.S. PATENT DOCUMENTS

| | | | | |
|---|---|---|---|---|
| 5,780,207 A | | 7/1998 | Mohapatra et al. | |
| 5,879,864 A | | 3/1999 | Yokokawa | |
| 6,017,684 A | * | 1/2000 | Miyake | 430/351 |

FOREIGN PATENT DOCUMENTS

| | | |
|---|---|---|
| JP | A218548 | 1/1990 |
| JP | A7234371 | 9/1995 |
| WO | WO9531754 | 11/1995 |

* cited by examiner

*Primary Examiner*—Thorl Chea

(57) ABSTRACT

An image-forming method using an exposure head having plural beam light sources that correspond to each exposure point and that emit each light with the same wavelength, to subject to exposure a light-sensitive material provided at least with a light-sensitive silver halide emulsion and a binder on a support, which method comprises arranging M sets of the beam light sources in a sub-scanning direction, perpendicular to a main scanning direction, along which the exposure head is moved, at predetermined intervals, and allowing the light-sensitive material to move in the sub-scanning direction, in steps of a distance of (the length of the exposure head in the aligned direction)/N ($N \geqq 2$), to carry out superposing exposure N times, with an exposure time per exposure being $10^{-3}$ sec or less, thereby forming M×N pixels per exposure head in every M sets of exposure point, to form an image, wherein the silver halide emulsion contains Ir, in an amount to be added of $10^{-7}$ to $10^{-10}$ mol per mol of silver halide. This method can eliminate or improve uneven density of exposure, particularly streaks on an image caused by a difference in the hysteresis-of multiple exposure of light source points at both ends of an exposure head in a scanning exposure-type image-forming method that uses in which plural exposure light sources whose exposure time per exposure is 10-3 sec or less.

10 Claims, No Drawings

IMAGE FORMING METHOD

FIELD OF THE INVENTION

The present invention relates to a method for forming an image, and more particularly to a method for forming an image by subjecting a heat-developable light-sensitive material to exposure to light using a plurality of exposure light sources.

BACKGROUND OF THE INVENTION

Heat-developable light-sensitive material is known in the art, and heat-developable light-sensitive materials and their processes are described, for example, in "Shashin Kogaku no Kiso (Higinen Shashin-hen)" (published by Korona-sha, 1982), pages 242 to 255, and in U.S. Pat. No. 4,500,626.

Further, methods wherein, for example, dye images are formed by the coupling reaction of the oxidized product of a developing agent with a coupler are described, for example, in U.S. Pat. No. 3,761,270 and U.S. Pat. No. 4,021,240. Furthermore, methods for forming a positive color image by the light-sensitive silver dye bleach process are described, for example, in U.S. Pat. No. 4,235,957.

Further, the method wherein a diffusion dye is released or formed imagewise by heat development and the resultant diffusion dye is transferred to a dye-fixing element is proposed. In this method, by changing the type of the dye-providing compound to be used or the type of the silver halide to be used, a negative dye image, as well as a positive dye image, can be obtained. More details are described, for example, in U.S. Pat. No. 4,500,626, U.S. Pat. No. 4,483,914, U.S. Pat. No. 4,503,137, U.S. Pat. No. 4,559,290, JP-A-58-149049 ("JP-A" means unexamined published. Japanese patent application), JP-A-60-133449, JP-A-59-218443, JP-A-61-238056, EP-A-220 746 (A2), the Journal of Technical Disclosure ("Kokai Giho") 87-6199, EP-A-210 660 (A2).

With respect to the method for obtaining a positive color image by heat development, various methods have been proposed. For example, U.S. Pat. No. 4,559,290 proposes a method wherein a so-called DRR compound, which has been formed into an oxidized compound incapable of releasing a dye image, is used under the coexistence with a reducing agent or a precursor thereof. In this method, the reducing agent is oxidized in proportion to the exposure amount of a silver halide by heat development, and the above oxidized compound is reduced with the unoxidized remaining reducing agent, to cause a diffusion dye to be released, to form a positive color image. Further, EP-A-220 746 (A) and the Journal of Technical Disclosure ("Kokai Giho") No. 87-6199 (Vol. 12, No. 22) describe heat-developable color light-sensitive materials wherein use is made, as a compound capable of releasing a diffusion dye by the same mechanism, of a compound capable of releasing a diffusion dye by reductive cleavage of the N—X bond, in which X represents an oxygen atom, a nitrogen atom, or a sulfur atom.

Since the heat-developable color light-sensitive material can be processed easily and rapidly in comparison with the conventional wet-development light-sensitive material, development can be conducted by means of a small-sized compact apparatus (devices). Accordingly, relatively inexpensive apparatuses as color printers, or color copies of a silver salt color light-sensitive material system, are being developed and sold. To further broaden the application of these apparatuses, it is considered that various improvements are required. As the exposure light source for these light-sensitive materials, various proposals are made, and as a digital exposure light source, for example, light-emitting diodes (LED), semiconductor lasers (LD), and various fluorescent substances are used.

When using inexpensive LEDs or LDs, one devised method used is that plural elements are placed side by side, to carry out scanning exposure, thereby shortening the time required for exposure. With regard to exposure methods using a multi-beam, there is a report of a patent using an outer drum system, in which a light-sensitive material is wound around a drum, to carry out exposure, since conveyance of the light-sensitive material on a plane is difficult to carry out.

In the exposure using a multi-beam, a multiple exposure effect, different in time interval from other exposure stations (exposure points), is given to the exposure stations at both ends, in the direction of an array of multi-beams from the exposure station adjacent to the focused exposure station. In this exposure method, an exposure head provided with plural beam light sources is used, to obtain a multi-beam, and a method in which the quantity of light of the light source applied to the exposure stations of both ends is compensated in accordance with LUT, is reported in the specification of JP-A-9-218474.

A method in which the number of multiple exposures using a multi-beam is increased, to prevent exposure streaks and to improve temperature dependency of exposure, is described in the specification of U.S. Pat. No. 5,879,864.

Also, a method in which the location of an exposure beam is changed from that in conventional methods, to carry out exposure in a so-called interleave system, thereby reducing a difference in the hysteresis of exposure, is described in IS & T's International Congress on Advances in Non-Impact Printing Technologies (1994) p. 337.

Each of these methods uses an outer drum system, and there is no description concerning small-sized and compact devices in these methods.

There is a description concerning the effect of multiple exposure and overlap of exposure beam in International Publication No. WO 95/31754 and JP-A-4-51043. However, inventions described therein are concerned with the case of exposure using a mono-beam, and nothing in them refers to the problems posed by exposure of a multi-beam.

JP-A-2-18548 reports that a silver halide emulsion is doped with a heavy metal, to thereby decrease variation in the photographic characteristics caused by multiple exposure during scanning exposure. However, nothing in the publication refers to the problems posed by multi-beam exposure.

JP-A-7-234371 reports an image-formation apparatus that restrains unevenness of density, caused by the effect of multiple exposure, by controlling the manner of superposing light beams in scanning exposure using a mono-beam. However, the publication includes nothing referring to the problems posed by multi-beam exposure.

JP-A-4-249244 describes improvement of a developer, as to a method of restraining the deterioration of the photographic characteristics that is caused when a scanning exposure operation with high intensity and short-time superposition is performed. However, the publication does not mention improvement by an exposure method, and also it nowhere refers to the problems posed by multi-beam exposure.

SUMMARY OF THE INVENTION

It is an object of the present invention to eliminate or improve uneven density of exposure, particularly streaks on an image that are caused by a difference in the hysteresis of multiple exposure of light source points at both ends of an exposure head in a scanning exposure-type image-forming method, in which plural exposure light sources, whose exposure time per exposure is $10^{-3}$ seconds or less, are used.

Other and further objects, features, and advantages of the invention will appear more fully from the following description.

DETAILED DESCRIPTION OF THE INVENTION

The above object is attained by the following means (1) to (6).

(1) An image-forming method, using an exposure head having plural beam light sources that correspond to each exposure station and that emit each light with the same wavelength, to expose to light a light-sensitive material, which is provided at least with a light-sensitive silver halide emulsion and a binder on a support; with the method comprising:

arranging M sets of the beam light sources of the exposure head in a sub-scanning direction, perpendicular to a main scanning direction, along which the exposure head itself is moved, at predetermined intervals, and allowing said light-sensitive material to move in said sub-scanning direction, in steps of a distance of (the length of the exposure head in the aligned direction)/N ($N \geqq 2$), to carry out superposing exposure N times, with an exposure time per exposure being $10^{-3}$ seconds or less, thereby forming M×N pixels per exposure head in every M sets of exposure station, to form an image, wherein the silver halide emulsion of said light-sensitive material contains Ir, in an amount to be added of $10^{-7}$ to $10^{-10}$ mol based on 1 mol of the silver halide.

(2) The image-forming method according to the above (1), wherein the silver halide emulsion contains Ir, in the amount to be added of $10^{-7}$ to $10^{-10}$ mol based on 1 mol of the silver halide, and Fe, in an amount to be added from $10^{-7}$ mol to $10^{-3}$ mol based on 1 mol of the silver halide.

(3) The image-forming method according to the above (1), wherein the silver halide emulsion comprises silver chlorobromide, which comprises silver chloride in an amount of 50 mol % or more of the total silver halide, and substantially free from silver iodide, and wherein particles of the silver halide each have a localized phase having silver bromide content of less than 80 mol %, with the localized phase containing at least 50% or more of the total amount of Ir added, when the particles of said silver halide are prepared.

(4) The image-forming method according to any one of the above (1) to (3), wherein the light-sensitive material is a heat-developable light-sensitive material containing, on a support, at least three silver halide emulsions differing in color sensitivity, a binder, and a developing agent, and a compound that reacts with an oxidized product of the developing agent to form a diffusible dye, or a dye-providing compound.

(5) The image-forming method according to any one of the above (1) to (4), wherein the light sources for exposure are LEDs each having an emission wavelength ranging from the visible range to the infrared range.

(6) The image-forming method according to any one of the above (1) to (5), wherein the light sources for exposure are selected from the group consisting of a blue LED, a green LED, and a red LED.

The relation between main scanning and sub-scanning in the exposure method for-use in the present invention will be explained. A main scanning direction (main scanning) is one along which a multi-exposure head is allowed to move, whereas a sub-scanning direction (sub-scanning) is one along which a light-sensitive material is allowed to move, namely, a direction perpendicular to the main scanning direction. The main scanning is basically reciprocating manner (to-and-fro writing). In the sub-scanning, a light-sensitive material is allowed to move intermittently synchronously with the main scanning by using a pulse motor in general. Although the exposure and the movement are generally conducted simultaneously, the both of exposure and movement may be conducted alternately as the case may be.

As the exposure head used in the present invention, one in which M sets of beam light sources which each emit light with the same wavelength are arranged at predetermined intervals in the aforementioned sub-scanning direction is used. The exposure head is allowed to move in the sub-scanning direction in steps of a distance of (the length of the exposure head in the aligned direction)/N ($N \geqq 2$), to carry out superposing exposure N times, thereby conducting exposure in every plural exposure stations of the exposure head, to form an image of M×N pixels per exposure head.

The unevenness of exposure mentioned in the present invention indicates a unique streak-like image defect caused in the case of exposing using the aforementioned exposure head. There are roughly three causes of occurrence of this streak.

(1) The unevenness of exposure that is caused by non-uniformity, for example, in the light intensities and wavelengths of plural beams, and in the modulation characteristic during exposure.

(2) The unevenness of exposure that is caused by insufficiency in the accuracy of movement in sub-scanning.

(3) The unevenness of exposure that is caused by the physical characteristics of a silver halide.

The present invention is to eliminate the cause of the above (3).

Namely, in the exposure method used in the present invention, normal portions are subjected to N repetitions of superposing exposure whereas joint portions between exposures are subjected to (N+1) repetitions of superposing exposure, to give physically equal exposure energy to each of the aforementioned M×N pixels. Differences in exposure strength, the number of exposures and interval between exposures between the normal portion and the exposure-joint portion cause a variation in sensitivity, thereby causing exposure streaks, even if these portions are exposed using the same light energy.

In the exposure system used in the present invention, a light emitting diode and various lasers (e.g., a laser diode and gas laser) are allowed to emit light according to image information converted into electric signals, to conduct scanning exposure.

For image information, image signals obtained from a video camera, electronic still camera and the like; television signals represented by Nippon Television Signal Constant (NTSC), image signals obtained by dividing an original image into a large number of pixels such as a scanner, or image signals made using a computer represented by a CG or a CAD, may be utilized.

It is particularly effective to use an LED that is an inexpensive light source, as the exposure light source for use in the present invention. In color sensitive materials, generally three types of LED having light emission wavelength regions corresponding to at least three spectral sensitivities differing in color sensitivity are used, and there is no particular limitation on the light emission wavelength regions from the visible range to the infrared range. In general, three types of light source are used among four types of light sources including infrared light source in addition to blue-, green- and red-light sources. In the case of intending to correspond to the spectral sensitivity of common color paper, a blue LED and/or a green LED and/or a red LED are used.

With regard to a wavelength range from the shortest wavelength to the longest wavelength as to the wavelength of the exposure light source used in the present invention, a blue LED having a wavelength range of ±10 nm and preferably ±5 nm selected from 430 to 480 nm, a green LED having a wavelength range of ±10 nm and preferably ±5 nm selected from 500 to 560 nm, and a red LED having a wavelength range of ±10 nm and preferably ±5 nm selected from 640 to 690 nm may be preferably used. The wavelength of the exposure light source used in the present invention is defined as the centroidal wavelength.

When scanning exposure is conducted according to image information converted into electric signals, it is unnecessarily particular to use colors in the visible range, namely a blue, a green and a red light source, but these light sources also including, for example, an infrared light source may be used by combining them appropriately.

When plural light sources are used according to the present invention, the number M of the light source for each emission color is preferably 2 to 400 and more preferably 5 to 100 in an A4-size type exposure apparatus. Each light source may be used after the quantity of light and wavelength thereof are measured separately to calibrate in advance.

Also, the number N of the superposition is preferably 2 to 10 and more preferably 2 to 5.

The light-sensitive element used in the present invention basically comprises a light-sensitive silver halide emulsion, a binder, a color-developing agent, and a compound which reacts with an oxidized product of the color-developing agent to form and release a diffusible dye, or a dye-providing (dye-donating) compound (there is the case where a reducing agent doubles as this compound as explained later), on a support, and it may further comprises an oxidizing agent of an organic metal salt, if required. Although these components are frequently added to the same layer, these components may be added to different layers separately as far as they are kept in a reactive condition. For example, if a colored dye-donating compound is allowed to exist in a layer under the silver halide emulsion layer, it prevents the sensitivity from decreasing. Although the reducing agent is preferably built in the light-sensitive element, it may be supplied from the outside by a method of, for example, diffusing it from a dye-fixing element explained later.

In order to obtain a wide-range color within the chromaticity diagram by using the three primary colors of yellow, magenta and cyan, at least three silver halide emulsion layers which respectively have light sensitivities in different spectrum regions are used in combination. The light-sensitive material used in the present invention comprises at least a green-sensitive layer and, other than this layer, two silver halide emulsion layers which respectively have light sensitivities in different spectrum regions. Generally, a combination of three layers, specifically, a blue-sensitive layer and a red-sensitive layer besides the green-sensitive layer, is adopted. Each light-sensitive layer may be disposed in various arranging orders common in usual color-sensitive materials. Also, each light-sensitive layer may be divided into two or more layers if necessary.

In the method of the present invention, generally a light-sensitive layer containing a yellow dye-donating compound is allowed to contain a silver halide emulsion (a blue-sensitive emulsion) having a spectral sensitivity in a wavelength range from 400 nm to 500 nm, a light-sensitive layer containing a magenta dye-donating compound is allowed to contain a silver halide emulsion (a green-sensitive emulsion) spectrally sensitized in a wavelength range from 500 nm to 600 nm and, likewise, a light-sensitive layer containing a cyan dye-donating compound is allowed to contain a silver halide emulsion (a red-sensitive emulsion) spectrally sensitized in a wavelength range from 600 nm to 740 nm. However, the light-sensible wavelength and the resultant hue from the dye-donating compound are not necessarily used in the above combination but may be used in optional combination.

Further, when the yellow light-sensitive layer is colored yellow, it is preferably the uppermost light-sensitive layer away from the base (support). That is, the combination is, from the base, a red-sensitive layer that contains a cyan-dye-providing compound, an intermediate layer, a green-sensitive layer that contains a magenta-dye-providing compound, an intermediate layer, a blue-sensitive layer that contains a yellow-dye-providing compound, an intermediate layer, and a protective layer.

If the cyan layer and the magenta layer are reversed, the properties are approximately the same. Each light-sensitive layer may consist of two layers, and each of the two layers may contain a dye-providing compound and a silver halide emulsion, or it is also possible that only the upper layer contains a silver halide emulsion and the lower layer contains a dye-providing compound, to make it high in sensitivity.

The heat-developable color light-sensitive material may be provided with various auxiliary layers such as a protective layer, an undercoat (substratum) layer, an intermediate layer, a yellow filter layer, an antihalation layer, and a backing layer. To the backing layer, a subbing layer and a protective layer may be further added.

When the support is made of polyethylene laminate paper containing a white pigment such as titanium oxide, the backing layer must be designed to have an antistatic function and a surface resistivity of $10^{12}$ Ω.cm or less.

In the exposure system used in the present invention, as aforementioned, an inexpensive LED and/or LD is used and hence the exposure is undergone at a high exposure intensity for an exposure time of $10^{-3}$ seconds or less. This causes the high-intensity reciprocity law failure problem to arise. As shown in, for example, JP-B-43-4935 ("JP-B" mean examined Japanese patent publication), it is widely known that, in order to improve the reciprocity law failure of a silver halide emulsion, it is effective to dope the emulsion with Ir. This doping is an essential technique to improve the reciprocity law failure. However, it has been found from the studies of the inventor of the present invention that the aforementioned exposure streaks, which are caused by a silver halide emulsion and produced along with the use of a multi-exposure head, correlates to the amount of Ir. Further studies have made unexpectedly it possible to improve the exposure streaks caused by a reduction in Dmax and a multi-exposure head in association with the reciprocity law failure, by designing the silver halide emulsion as follows. The silver halide emulsion used in the heat-developable color light-sensitive material for use in the present invention will be hereinafter explained in detail.

In the present invention, the silver halide emulsion is one to which Ir is added in an amount of $10^{-7}$ mol or less, and preferably $10^{-8}$ mol or less, per one mol of the silver halide. It is preferable to remove Ir in view of streaks in more multiple exposure. In the high-intensity exposure according to the present invention, however, there is a possibility that the reciprocity law failure will be invited in the absence of Ir and hence the lower limit of Ir to be added is about $10^{-10}$ mol.

As the iridium compound used in the present invention, a water-soluble iridium compound may be used. Examples of the iridium compound include iridium (III) halide compounds, iridium (IV) halide compounds, and iridium complex salts, having, as a ligand, a halogen, amines, oxalate and the like, such as hexachloroiridium (III) or (IV) complex salts, hexammineiridium (III) or (IV) complex salts and trioxalaltoiridium (III) or (IV) complex salts. In the present invention, among these compounds, those of iridium (III) and those of iridium (IV) may be used in optional combinations. Each of these iridium compounds is dissolved in water or a proper solvent upon use. For this, a method which is generally often used to stabilize a solution of an iridium compound, namely a method in which a hydrogen halide solution (e.g., hydrochloric acid, hydrobromic acid or hydrofluoric acid) is added or a method in which an alkali halide (e.g., KCl, NaCl, KBr, NaBr, and the like) is added, may be used. It is possible to add and dissolve another silver halide fine particles that have been doped with iridium in advance when preparing the silver halide particles according to the present invention, instead of using a water-soluble iridium compound.

Preferably the light-sensitive silver halide emulsion used in the present invention contains Fe for the purpose of compensating the high-intensity reciprocity law failure because the amount of Ir to be added is limited to $10^{-7}$ mol or less based on one mol of the silver halide. The amount of Fe to be added is in a range preferably from $10^{-7}$ mol to $10^{-3}$ mol, and more preferably from $10^{-6}$ mol to $10^{-4}$ mol, per mol of the silver halide. A Fe compound is preferably water-soluble to the extent that it can be used in the present invention. Particularly, the iron compound is a compound containing divalent or trivalent iron and preferably is water-soluble to the extent that it can be used in the present invention. Especially preferable iron compound is an iron complex salt which is easily incorporated into the silver halide particles. Specific examples of the iron compound include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, ferric sodium pyrophosphate, ferric thiocyanate, ferric sulfate, ferric ammonium sulfate, ferric guanidium sulfate, ferric ammonium citrate, potassium hexacyanoiron (II) acid salt, pentacyanoammineiron (II) potassium, iron (III) sodium ethylenedinitrotetraacetate, hexacyanoiron (III) potassium, tris(bipyridyl)iron (III) chloride, and petacyanonitrosyliron (III) potassium.

Among these compounds, particularly a hexacyanoiron (II) acid salt, hexacyanoiron (III) acid salt, ferrous thiocyanate or ferric thiocyanate exhibits a remarkable effect.

The aforementioned iron compound is allowed to exist in a solution of a dispersion medium (a gelatin or a polymer having protective colloidal characteristic), in an aqueous halide solution, in an aqueous silver salt solution or in another aqueous solution, thereby allowing the silver halide particles to contain the iron compound when the silver halide particles are formed.

In the present invention, impurity polyvalent metals other than Ir and Fe may be combined and allowed to be contained in silver halide particles. Given as examples of such an impurity metal include ions of metals of the VIII group (in the periodic table), such as Co, Ni, Ru, Rh, Pd, Os and Pt. Particularly, a combination with Rh is preferably adopted. The amount of the impurity metal to be added is generally about 0 to $10^{-5}$ mol per one mol of silver halide, although it depends on the purpose.

The high-intensity reciprocity law failure is increasingly made worse along with increased silver chloride content and a necessary amount of Ir to be added is also increased relatively. Therefore, in the case of silver chlorobromide in which 50 mol % or more of the total silver halide is silver chloride and silver iodide is not substantially contained, preferably the aforementioned silver halide particles have a localized phase with the content of silver bromide being less than 80 mol % and at least 50% or more of the total Ir added in the preparation of the aforementioned silver halide particles is added to the localized phase. Herein, the term "substantially free from (or not substantially containing) silver iodide" means that the silver iodide content is preferably 0.5 mol % or less, and more preferably 0 mol %.

The localized phase having high content of silver bromide may be optionally located according to the purpose. The localized phase may be positioned either in the inside of or on the surface or subsurface of the silver halide particles, or it may be divided into two parts which are positioned in the inside of and on the surface or subsurface of the silver halide particles. Also, the localized phase, in the inside and/or on the surface, may form such a layer structure as to enclose the silver halide particles or may have a discontinuously isolated structure.

The content of silver bromide in the localized phase can be analyzed using, for example, an X-ray diffraction method (described in, for example, "New Experimental Chemistry Lecture 6, Structure Analysis, edited by Japan Chemical Association" Maruzen) or an XPS method (described in, for example, "Surface Analysis,—Application of IMA, Auger Electron,Photoelectron Spectrum-", published by Kodansha). The localized phase is constituted of silver in an amount of preferably 0.1 to 20%, and more preferably 0.5 to 7%, of the total silver amount constituting the silver halide particles used in the present invention.

The interface between such a localized phase with high silver bromide content and other phase may have either a clear phase boundary or a short transition zone where the halogen composition gradually changes.

Various methods may be used to form such a localized phase having high silver bromide content. For example, a soluble silver and a soluble halide may be reacted by a single-jet mixing method or a double-jet mixing method, to form the localized phase. Moreover, the localized phase may be formed using a so-called conversion method involving a process of converting a silver halide, which has been already formed, into a silver halide having lower solubility. Alternatively, the localized phase can also be formed by adding silver bromide fine particles to recrystallize them on the surface of silver chlorobromide particles.

The method of adding Ir is as aforementioned.

The silver halide emulsion can contain gold in an amount of generally $1.0\times10^{-7}$ mol to $1.0\times10^{-4}$ mol, and preferably $5.0\times10^{-7}$ mol to $5.0\times10^{-5}$ mol, per mol of silver.

Such a content of gold is the amount to be contained finally in the silver halide emulsion, and that gold is added mainly when the silver halide emulsion is prepared, specifically when it is subjected to chemical sensitization, but the present invention is not limited by the timing when gold is added.

As is described later, the timing of the addition may be at any stage of chemical sensitization, or the addition may be made after the process of the chemical sensitization but before the application. Also the addition may be made before the removal of excess salts after the formation of particles (grains).

Further, the gold for the gold sensitization may be added in portions separately so that the amount of gold may fall in the above range. That addition may be carried out continuously or discontinuously. In the chemical sensitization, gold may be added in an amount smaller than the above prescribed amount and the deficiency is supplied at a time from after the completion of the chemical sensitization to immediately before the application. When the amount of gold is too large, a thermal fog is easily caused when a light-sensitive material containing a silver halide emulsion subjected to gold/sulfur sensitization is subjected to heat development, whereas the amount is too small, it becomes hard to obtain a clear effect of gold sensitization.

In the silver halide emulsion layer, the gold sensitizer is present mainly on the silver halide grain surface, but part thereof may be present in the gelatin, the binder.

For the gold sensitization in the present invention, the oxidation number of the gold in the gold sensitizer may be a valence of +1 or +3, and specifically, for example, a chloroaurate, potassium chloroaurate, auric trichloride, potassium auricthiocynate, potassium iodoaurate, and tetracyanoauric acid can be used.

The chemical sensitization can be carried out by such gold sensitization only, or by such gold sensitization in combination with sulfur or selenium sensitization, with the latter preferred. Further, other chemical sensitization, such as reduction sensitization, can be additionally used.

With respect to the conditions, such as the temperature, the pH, and the pAg, under which the chemical sensitization is carried out, the temperature is generally 40 to 90° C. and preferably 45 to 75° C., the pH is generally 3 to 9 and preferably 4 to 8, and the pAg is generally 5 to 11 and preferably 6 to 9.

In the present invention, as described above, gold sensitization and sulfur sensitization can be used in combination, also, sulfur sensitization can be used alone.

The sulfur sensitizer for the sulfur sensitization includes active gelatin and a sulfur-containing compound reactive with silver, and, for example, thiosulfates, ally thiocarbamide, thiourea, ally isothiocyanates, cystine, p-toluene thiosulfonates, thiocyanogen (rhodan), and mercapto compounds are used.

Further, those described, for example, in U.S. Pat. No. 1,574,944, U.S. Pat. No. 2,410,689, U.S. Pat. No. 2,278,947, U.S. Pat. No. 2,728,668, and U.S. Pat. No. 3,656,955 can also be used.

The sulfur sensitizer can be used in an amount generally ranging from $10^{-7}$ to $10^{-2}$ per mol of silver.

In the present invention, selenium sensitization can be used as described above. As the selenium sensitizer, for example, aliphatic isoselenocyanates, such as ally isoselenocyanate; selenoureas, selenoketons, selenoamides, selenocarboxylic acids, selenoesters, selenophosphates, and selenides, such as diethyl selenide and diethyl diselenide, can be used, and their specific examples are described in U.S. Pat. No. 1,574,944, U.S. Pat. No. 1,602,592, and U.S. Pat. No. 1,623,499.

The selenium sensitizer can be used in an amount generally ranging from $10^{-7}$ to $10^{-2}$ per mol of silver.

Other chemical sensitization method that can be additionally used in the present invention includes the reduction sensitization method wherein a reducing substance (e.g., stannous salts, amines, hydrazine derivatives, formamidinesulfinic acids, and silane compounds) is used, and the noble metal sensitization method wherein a noble metal compound (e.g., a complex salt of a metal of Group 8 of the periodic table, such as Pt, It, and Pd) is used.

The reduction sensitization method is described, for example, in U.S. Pat. No. 2,983,609, U.S. Pat. No. 2,419,974, and U.S. Pat. No. 4,054,458, and the noble metal sensitization method is described, for example, in U.S. Pat. No. 2,399,083, U.S. Pat. No. 2,448,060, and Great Britain Patent No. 618 061.

The addition of the gold sensitizer in the case wherein gold sensitization is used in combination with sulfur sensitization or selenium sensitization may be carried out at the same time as that of the sulfur sensitizer or the selenium sensitizer, or during the sulfur sensitization or selenium sensitization or after the completion thereof. The same is applied if other chemical sensitization is additionally used.

In the present invention, these chemical sensitizers including the gold sensitizer are added to the silver halide photographic emulsion in the usual manner. That is, in the case of compounds soluble in water, they are added in the form of an aqueous solution, and in the case of compounds soluble in an organic solvent, they are added in the form of a solution of an organic solvent readily mixable with water, such as methanol and ethanol.

The chemical sensitization can be carried out in the presence of a nitrogen-containing heterocyclic compound (Great Britain Patent No. 1,315,755, JP-A-50-63914, JP-A-51-77223, JP-A-58-126526, and JP-A-58-215644).

It is also useful to carry out the chemical sensitization in the presence of an acetylene compound, as described in JP-B-39-22067 ("JP-B" means examined Japanese patent publication) and JP-B-39-22068, in order to obtain a silver halide emulsion low in fogging.

Further, it is also effective to carry out the chemical sensitization in the presence of a silver halide solvent. As the silver halide solvent used, thiocyanates and solvents described in JP-A-63-151618 can be used.

The silver halide emulsion that can be used in the present invention may be made of any of silver chloride, silver bromide, silver iodobromide, silver chlorobromide, silver chloroiodide, and silver chloroiodobromide.

The silver halide emulsion-that is used in the present invention may be a surface-latent-image-type emulsion or an internal-latent-image-type emulsion. The internal-latent-image-type emulsion is used in combination with a nucleator or a light-fogging agent, to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or polydisperse emulsion. A technique is preferably used wherein the gradation is adjusted by mixing monodisperse emulsions, as described in JP-A-1-167743 or JP-A-4-223463. The grain size is preferably 0.1 to 2 $\mu$m, and particularly preferably 0.15 to 1.0 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, JP-A-64-13546, JP-A-2-236546, and JP-A-3-110555; by P. Glafkides in Chemie et Phisique Photographique, Paul Montel (1967); by G. F. Duffin in Photographic Emulsion Chemistry, Focal Press, 1966; and by V. L. Zelikman et al., in Making and Coating Photographic Emulsion, Focal Press, 1964.

In the process for preparing the light-sensitive silver halide emulsion for use in the present invention, so-called desalting, for removing excess salts, is preferably carried out. As means for attaining it, the noodle water-washing method, which is carried out with the gelatin gelled, can be used, and also the sedimentation method, in which inorganic salts comprising polyvalent anions (e.g. sodium sulfate), an anionic surfactant, an anionic polymer (e.g. polystyrene-sulfonic acid sodium salt), or a gelatin derivative (e.g. an aliphatic-acylated gelatin, an aromatic-acylated gelatin, and an aromatic-carbamoylated gelatin) is employed, can be used, with the sedimentation method preferred.

In the step for forming grains of the light-sensitive silver halide emulsion for use in the present invention, as a silver halide solvent, a rhodanate, ammonia, a tetrasubstituted thioether compound, an organic thioether derivative described in JP-B-47-11386, or a sulfur-containing compound described in JP-A-53-144319 can be used.

As other conditions employed to prepare the emulsion in the present invention, the description, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of the acid process, the neutral process, the ammonia process, and the like can be used; and to react a soluble silver salt with a soluble halogen salt, any of the single-jet method, the double-jet method, a combination thereof, and the like can be used. To obtain monodispersed emulsion, the double-jet method is preferably used.

A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used.

Further, to quicken the growth of the crystals, the concentrations, the amounts, and the speeds of the silver salt and the halide to be added may be increased (e.g. JP-A-55-142329 and JP-A-55-158124, and U.S. Pat. No. 3,650,757).

As the method of stirring the reaction liquid, any of known stirring methods may be used. The temperature and the pH of the reaction liquid during the formation of the silver halide grains may be set arbitrarily to meet the purpose. Preferably the pH range is 2.2 to 8.5, and more preferably 2.5 to 7.5.

The coating amount of the light-sensitive silver halide emulsion used in the present invention is generally in the range of 1 $mg/m^2$ to 10 $g/m^2$ in terms of silver.

The preparation of the silver halide used in the present invention allowed to have sensitivity to a color in a blue range, green range, red range or infrared range is attained by carrying out the spectral sensitization of a light-sensitive silver halide emulsion by using methine dyes and the like. Examples of these dyes to be used include cyanine dyes, merocyanine dyes, composite cyanine dyes, composite merocyanine dyes, holopolar cyanine dyes, hemicyanine dyes, styryl dyes and hemioxonol dyes. Specific examples include sensitizing dyes described, for example, in U.S. Pat. No. 4,617,257, JP-A-59-180550, JP-A-64-13546, JP-A-5-45828, JP-A-5-45834, RD No. 17,643, RD No. 18,716 and RD No. 307,105.

These sensitizing dyes may be used in combinations for the purpose of providing supersensitization and controlling color sensitivity and for other purposes. It is preferable to combine sensitizing dyes range between two and five. Six or more sensitizing dyes may be combined.

Together with the sensitizing dye, a dye having no spectral sensitizing action itself, or a compound that does not substantially absorb visible light and that exhibits supersensitization (e.g. those described, for example, in U.S. Pat. No. 3,615,641 and JP-A-63-23145), may be contained in the emulsion.

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. No. 4,183,756 and U.S. Pat. No. 4,225,666. Further, these sensitizing dyes and supersensitizers may be added in the form of a solution of an organic solvent, such as methanol, or in the form of a dispersion of gelatin and the like, or in the form of a solution of a surface-active agent. Generally the amount of the sensitizing dye to be added is of the order of $10^{-8}$ to $10^{-2}$ mol per mol of the silver halide.

These additives used in the above process, and conventionally known additives for photography that can be used in the heat-developable light-sensitive materials and dye-fixing materials which is used in the present invention, are described in Research Disclosure (RD) No. 17643; Research Disclosure No. 18176; and Research Disclosure No. 307105, whose particular parts are given below in a table.

| Additive | RD 17643 | RD 18716 | RD 307105 |
|---|---|---|---|
| 1 Chemical sensitizers | p. 23 | p. 648 (right column) | p. 866 |
| 2 Sensitivity-enhancing agents | — | p. 648 (right column) | — |
| 3 Spectral sensitizers and Supersensitizers | pp. 23–24 | pp. 648 (right column)–649 (right column) | pp. 866–868 |
| 4 Brightening agents | p. 24 | pp. 648 (right column) | p. 868 |
| 5 Antifogging agents and Stabilizers | pp. 24–25 | p. 649 (right column) | pp. 868–870 |
| 6 Light absorbers, Filter dyes, and UV Absorbers | pp. 25–26 | pp. 649 (right column)–650 (left column) | p. 873 |
| 7 Dye image stabilizers | p. 25 | p. 650 (left column) | p. 872 |
| 8 Hardeners | p. 26 | p. 651 (left column) | pp. 874–875 |
| 9 Binders | p. 26 | p. 651 (left column) | pp. 873–874 |
| 10 Plasticizers and Lubricants | p. 27 | p. 650 (right column) | p. 876 |
| 11 Coating aids | pp. 26– | p. 650 (right | pp. 875–876 |

-continued

| Additive | RD 17643 | RD 18716 | RD 307105 |
|---|---|---|---|
| and Surfactants | 27 | column) | |
| 12 Antistatic agents | p. 27 | p. 650 (right column) | pp. 876–877 |
| 13 Matting agents | — | — | pp. 878–879 |

As the binder of the constitutional layer of the heat-developable light-sensitive material or the dye-fixing material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include proteins, such as gelatin and gelatin derivatives; cellulose derivatives; such natural compounds as polysaccharides, including starches, acacia, dextrans, and pullulan; and such synthetic polymer compounds as polyvinyl alcohols, polyvinyl pyrrolidones, and acrylamide polymers. Highly water-absorptive polymers described, for example, in U.S. Pat. No. 4,960,681 and JP-A-62-245260; that is, homopolymers of vinyl monomers having —COOM or —$SO_3M$ (M represents a hydrogen atom or an alkali metal), or copolymers of these vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or so-called de-ashed gelatin, wherein the contents of calcium, etc., are reduced, can be selected to meet various purposes, and combinations of these gelatins are also preferably used.

If a system wherein the heat development is carried out with a slight amount of water supplied is adopted, the absorption of water can be rapidly carried out by using the above high-water-absorptive polymer. Further, when the high-water-absorptive polymer is used in the dye-fixing layer or its protective layer, after the transfer the dye can be prevented from transferring again from the dye-fixing element to another material.

In the present invention, the coating amount of the binder is preferably 20 g or less, more preferably 10 g or less, and further preferably 0.5 to 7 g, per $m^2$.

In the present invention, the light-sensitive silver halide emulsion may be used together with an organic metal salt as an oxidizing agent. Among the organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide. Suitably the total coating amount of the light-sensitive silver halide emulsion and organosilver salts is generally 0.05 to 10 g/$m^2$, and preferably 0.1 to 4 g/$m^2$, in terms of silver.

As the reducing agent that can be used in the present invention, those known in the field of heat-developable light-sensitive material can be used. Further, the later-described dye-providing compounds having reducibility are also included (in this case, another reducing agent can be used additionally). Reducing agent precursors that have no reducibility themselves but exhibit reducibility by the action of heat or a nucleophilic agent during the process of development, can be used.

Examples of the reducing agent that can be used in the present invention include reducing agents and reducing agent precursors described, for example, in U.S. Pat. No. 4,500,626, columns 49 to 50, U.S. Pat. No. 4,839,272, U.S. Pat. No. 4,330,617, U.S. Pat. No. 4,590,152, U.S. Pat. No. 5,017,454, U.S. Pat. No. 5,139,919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages (40) to (57), JP-A-1-120553, JP-A-2-32338, JP-A-2-35451, JP-A-2-234158, JP-A-3-160443, and European Patent No. 220 746, pages 78 to 96.

Combinations of various reducing agents as disclosed in U.S. Pat. No. 3,039,869 can also be used.

When a non-diffusible reducing agent is used, an electron-transport agent and/or an electron-transport agent precursor can be used additionally, if necessary, in order to accelerate the electron transport between the non-diffusible reducing agent and the developable silver halide. Particularly preferably, those described, for example, in the above-mentioned U.S. Pat. No. 5,139,919, EP-A-418 743, JP-A-1-138556, and JP-A-3-102345 are used. Further, a method wherein it is introduced in a layer stably as described in JP-A-2-230143 and JP-A-2-235044 is preferably used.

The electron-transport agent or its precursor can be chosen from among the above reducing agents or their precursors. The electron-transport agent and its precursor are desirably greater in its movability than the non-diffusible reducing agent (electron provider). Particularly useful electron-transport agents are 1-phenyl-3-pyrazolidones and aminophenols.

As the non-diffusible reducing agent (electron provider) used in combination with the electron-transport agent, those that are among the above reducing agents and that are substantially not movable in the layers of the light-sensitive material are suitable. As examples of those, preferably, for example, hydroquinones, sulfonamidophenols, sulfonamidonaphtholes, compounds described as electron providers in JP-A-53-110827, U.S. Pat. No. 5,032,487, U.S. Pat. No. 5,026,634, and U.S. Pat. No. 4,839,272, and the below-described non-diffusible, dye-providing compounds having reducibility can be mentioned.

Electron provider precursors as described in JP-A-3-160443 are also preferably used.

Further, the above reducing agents can be used in intermediate layers and protective layers for various purposes, for example, of the color-mixing inhibition, the improvement of color reproduction, the improvement of the white background, and the prevention of silver from migrating to the dye-fixing material. Specifically, reducing agents described in EP-A-524 649, EP-A-357 040, JP-A-4-249245, JP-A-2-64633, JP-A-2-46450, and JP-A-63-186240 are preferably used. Reducing compounds that release a development inhibitor, as described in JP-B-3-63733, JP-A-1-150135, JP-A-2-110557, JP-A-2-64634, JP-A-3-43735, and EP-A-451 833, can also be used.

The total amount of the reducing agent to be added in the present invention is generally 0.01 to 20 mol, and preferably 0.1 to 10 mol, per mol of silver.

In the present invention, use is made particularly preferably of a color-developing agent, as represented by formula (I), to form a color image.

formula (I)

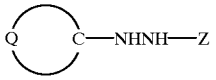

In the formula, Z represents a carbamoyl group, an acyl group, an alkoxycarbonyl group, an aryloxycarbonyl group, a sulfonyl group or a sulfamoyl group, and Q represents a group of atoms necessary to form a five- to seven-membered unsaturated ring together with the C.

The compound represented by formula (I) for use in the present invention will be explained in detail.

In formula (I), Z represents a carbamoyl group (a carbamoyl group having generally 1 to 50 and preferably 6 to 40 carbon atoms, e.g., unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl), an acyl group (an acyl group having generally 1 to 50 and preferably 6 to 40 carbon atoms, e.g., formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl), an alkoxycarbonyl group (an alkoxycarbonyl group having generally 2 to 50 and preferably 6 to 40 carbon atoms, e.g., methoxycarbonyl, ethoxycarbonyl, isobutyloxycarbonyl, cyclohexyloxycarbonyl, dodecyloxycarbonyl, and benzyloxycarbonyl), an aryloxycarbonyl group (an aryloxycarbonyl group having generally 6 to 50 and preferably 6 to 40 carbon atoms, e.g., phenoxycarbonyl, 4-octyloxyphenoxycarbonyl, 2-hydroxymethylphenoxycarbonyl, and 4-dodecyloxyphenoxycarbonyl), a sulfonyl group (a sulfonyl group having generally 1 to 50 and preferably 6 to 40 carbon atoms, e.g., methylsulfonyl, butylsulfonyl, octylsulfonyl, 2-hexadecylsulfonyl, 3-dodecyloxypropylsulfonyl, 2-octyloxy-5-t-octylphenylsulfonyl, and 4-dodecyloxyphenylsulfonyl), or a sulfamoyl group (a sulfamoyl group having generally 1 to 50 and preferably 6 to 40 carbon atoms, e.g., unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl).

The group represented by Z may have a substituent. Preferable examples of the substituent include a halogen atom (e.g., fluorine atom, chlorine atom and bromine atom), an alkyl group (a straight-chain, branched or cyclic alkyl group preferably having 1 to 32 carbon atoms, e.g., methyl, ethyl, propyl, isopropyl, butyl, t-butyl, 1-octyl, tridecyl, cyclopropyl, cyclopentyl, cyclohexyl, 1-norbornyl and 1-adamantyl), an alkenyl group (an alkenyl group preferably having 2 to 32 carbon atoms, e.g., vinyl, allyl and 3-butene-1-yl), an aryl group (an aryl group preferably having 6 to 32 carbon atoms, e.g., phenyl, 1-naphthyl and 2-naphthyl), a heterocyclic group (a five- to eight-membered heterocyclic group preferably having 1 to 32 carbon atoms, e.g., 2-thienyl, 4-pyridyl, 2-furyl, 2-pyrimidinyl, 2-pyridyl, 2-benzothiazolyl, 1-imidazolyl, 1-pyrazolyl and benzotriazole-2-yl), a cyano group, a silyl group (a silyl group preferably having 3 to 32 carbon atoms, e.g., trimethylsilyl, triethylsilyl, tributylsilyl, t-butyldimethylsilyl and t-hexyldimethylsilyl), a hydroxyl group, a nitro group, an alkoxy group (an alkoxy group preferably having 1 to 32 carbon atoms, e.g., methoxy, ethoxy, 1-butoxy, 2-butoxy, isopropoxy, t-butoxy, dodecyloxy, cyclopentyloxy and cyclohexyloxy), an aryloxy group (an aryloxy group preferably having 6 to 32 carbon groups, e.g., phenoxy and 2-naphthoxy), a heterocyclic oxy group (a heterocyclic oxy group preferably having 1 to 32 carbon atoms, e.g., 1-phenyltetrazole-5-oxy, 2-tetrahydropyranyloxy and 2-furyloxy), a silyloxy group (a silyloxy group preferably having 1 to 32 carbon atoms, e.g., trimethylsilyloxy, t-butyldimethylsilyloxy and diphenylmethylsilyloxy), an acyloxy group (an acyloxy group preferably having 2 to 32 carbon atoms, e.g., acetoxy, pivaloyloxy, benzoyloxy and dodecanoyloxy), an alkoxycarbonyloxy group (an alkoxycarbonyloxy group preferably having 2 to 32 carbon atoms, e.g., ethoxycarbonyloxy, t-butoxycarbonyloxy and cyclohexyloxycarbonyloxy), an aryloxycarbonyloxy group (an aryloxycarbonyloxy group preferably having 7 to 32 carbon atoms, e.g., phenoxycarbonyloxy), a carbamoyloxy group (a carbamoyloxy group preferably having 1 to 32 carbon atoms, e.g., N,N-dimethylcarbamoyloxy and N-butylcarbamoyloxy), a sulfamoyloxy group (a sulfamoyloxy group preferably having 1 to 32 carbon atoms, e.g., N,N-diethylsulfamoyloxy and N-propylsulfamoyloxy), an alkylsulfonyloxy group (an alkylsulfonyloxy group preferably having 1 to 32 carbon atoms, e.g., methylsulfonyloxy, hexadecylsulfonyloxy and cyclohexylsulfonyloxy), an arylsulfonyloxy group (an arylsulfonyloxy group preferably having 6 to 32 carbon atoms, e.g., phenylsulfonyloxy), an acyl group (an acyl group preferably having 1 to 32 carbon atoms, e.g., formyl, acetyl, pivaloyl, benzoyl, tetradecanoyl and cyclohexylcarbonyl), an alkoxycarbonyl group (an alkoxycarbonyl group preferably having 2 to 32 carbon groups, e.g., methoxycarbonyl, ethoxycarbonyl, octadecyloxycarbonyl and cyclohexyloxycarbonyl), an aryloxycarbonyl group (an aryloxycarbonyl group preferably having 7 to 32 carbon atoms, e.g., phenoxycarbonyl), a carbamoyl group (a carbamoyl group preferably having 1 to 32 carbon atoms, e.g., carbamoyl, N,N-dibutylcarbamoyl, N-ethyl-N-octylcarbamoyl, N-propylcarbamoyl and N,N-dicyclohexylcarbamoyl), an amino group (an amino group preferably having 32 or less carbon atoms, e.g., amino, methylamino, N,N-dioctylamino, tetradecylamino, octadecylamino and cyclohexylamino), an anilino group (an anilino group preferably having 6 to 32 carbon atoms, e.g., anilino and N-methylanilino), a heterocyclic amino group (a heterocyclic amino group preferably having 1 to 32 carbon atoms, e.g., 4-pyridylamino), a carbonamide group (a carbonamide group preferably having 2 to 32 carbon atoms, e.g., acetamide, benzamide and tetradecanamide), a ureide group (a ureide group preferably having 1 to 32 carbon atoms, e.g., ureide, N,N-dimethylureide and N-phenylureide), an imide group (an imide group preferably having 4 to 32 carbon atoms, e.g., N-succinimide and N-phthalimide), an alkoxycarbonylamino group (an alkoxycarbonylamino group preferably having 2 to 32 carbon atoms, e.g., methoxycarbonylamino, ethoxycarbonylamino, t-butoxycarbonylamino, octadecyloxycarbonylamino and cyclohexyloxycarbonylamino), an aryloxycarbonylamino group (an aryloxycarbonylamino group preferably having 7 to 32 carbon atoms, e.g., phenoxycarbonylamino), a sulfonamide group (a sulfonamide group preferably having 1 to 32 carbon atoms, e.g., methanesulfonamide, butanesulfonamide, benzenesulfonamide, hexadecanesulfonamide and cyclohexylsulfonylamino), a sulfamoylamino group (a sulfamoylamino group preferably having 1 to 32 carbon atoms, e.g., N,N-dipropylsulfamoylamino and N-ethyl-N-dodecylsulfamoylamino), an azo group (an azo group preferably having 1 to 32 carbon atoms, e.g., phenylazo), an alkylthio group (an alkylthio group preferably having 1 to 32 carbon atoms, e.g., ethylthio, octylthio and cyclohexylthio), an arylthio group (an arylthio group preferably having 6 to 32 carbon atoms, e.g., phenylthio), a heterocyclic thio group (a heterocyclic thio group preferably having 1 to 32 carbon atoms, e.g., 2-benzothiazolylthio, 2-pyridylthio and 1-phenyltetrazolylthio), an alkylsulfinyl group (an alkylsulfinyl group preferably having 1 to 32 carbon atoms, e.g., dodecanesulfinyl), an arylsulfinyl group (an arylsulfinyl group preferably having 6 to 32 carbon atoms, e.g., phenylsulfinyl), an alkylsulfonyl group (an alkylsulfonyl group preferably having 1 to 32 carbon atoms, e.g., methylsulfonyl, octylsulfonyl and cyclohexylsulfonyl), an arylsulfonyl group (an arylsulfonyl group preferably having 6 to 32 carbon atoms, e.g., phenylsulfonyl and 1-naphthylsulfonyl), a sulfamoyl group (a sulfamoyl group preferably having 32 or less carbon atoms, e.g., sulfamoyl, N,N-dipropylsulfamoyl and N-ethyl-N-dodecylsulfamoyl), a sulfo group, a phosphonyl group (a phosphonyl group preferably having 1 to 32 carbon atoms, e.g., phenoxyphosphonyl, octyloxyphosphonyl and phenylphosphonyl), and a phosphinoylamino group (diethoxyphosphinoylamino and dioctyloxyphosphinoylamino).

Q represents a group of atoms necessary to form a five- to seven-membered unsaturated ring together with the C. Preferable examples of the unsaturated ring include a benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isoxazole ring and thiophene ring. Condensed rings obtained by condensing these rings together are also preferable. These rings may have a substituent. Preferable substituents are the same as those mentioned for the group represented by Z.

Next, a preferable scope of the compound represented by formula (I) will be explained. Z is preferably a carbamoyl group, and more preferably a carbamoyl group having at least one hydrogen atom bound to the nitrogen atom. The unsaturated ring formed by Q and the carbon atom C is preferably a five- or six-membered ring, and more preferably a benzene ring, pyrimidine ring, 1,2,3-triazole ring, 1,2,4-triazole ring, tetrazole ring, 1,3,4-thiadiazole ring, 1,2,4-thiaziazole ring, 1,3,4-oxadiazole ring, 1,2,4-oxadiazole ring, thiazole ring, oxazole ring, isothiazole ring, isoxazole ring, or a ring obtained by condensing each of these rings with a benzene ring or unsaturated heterocycle.

Specifically, the compounds (1) to (80) described in the specification of JP-A-8-286340, pp7–22; the compounds H-1 to H-72 described in the specification of JP-A-9-152700, pp9–26; the compounds D-1 to D-19 described in the specification of JP-A-9-152701, pp7–11; the compounds D-1 to D-39 described in the specification of JP-A-9-152702, pp6–13; the compounds D-1 to D-49 described in the specification of JP-A-9-152703, pp7–17; and the compounds (1) to (45) described in the specification of JP-A-9-152704, pp6–18; are preferable as the color-developing agent used in the present invention.

It is preferable to use the color-developing agent for use in the present invention, together with a compound (a coupler) which forms a dye by oxidation coupling reaction. In the present invention, as the coupler, a so-called "two-equivalent coupler" is preferable in which the coupling position is substituted with a coupling split-off group other than a hydrogen atom, among couplers used in conventional silver salt photography using a paraphenylenediamine developing agent as a developing agent. There is a description concerning the two-equivalent coupler in "Theory of the Photographic Process" (4th. Ed., edited by T. H. James, MaCmillan, 1977) pp354–361, "Fundamentals of Photographic Engineering-Silver Salt Photography edition" (edited by Photographic Society of Japan, Corona, (1998), pp244–258), and the like.

Couplers which may be used in the present invention will be hereinafter explained. Examples of the coupler which may be used in the present invention include those represented by formula (1) to (12) which are explained in the specification of JP-A-9-152705, pp20–23. In these couplers, the number of total carbon atoms in the portions except for Y is in a range preferably from 1 to 30, more preferably from 1 to 24, and most preferably from 1 to 18.

Specifically, the exemplified compounds (C-1) to (C-50) described in the specification of JP-A-9-152705, pp24–37 are preferable as the coupler used in the present invention.

The amount to be added of the coupler used in the present invention, though it depends on the molar extinction coefficient ($\epsilon$) of the resultant dye, is generally about 0.001 to 100 mmol/m$^2$, preferably 0.01 to 10 mmol/m$^2$, and more preferably 0.05 to 5.0 mmol/m$^2$, as a coated product to obtain an image density of 1.0 or more as the reflection density in the case of using a coupler characterized in that the molar extinction coefficient ($\epsilon$) of the dye produced by coupling is about 5,000 to 500,000. Also, the amount to be added of the color-developing agent represented by formula (I) for use in the present invention ranges widely, and a proportion of the color-developing agent is preferably 0.01 to 100 times by mol, and more preferably 0.1 to 10 times by mol, as much as that of the coupler.

In the method of adding the coupler and the developing agent represented by formula (I), firstly the coupler, the developing agent and a high boiling point organic solvent (e.g., an alkyl phosphate or alkyl phthalate) are mixed with each other and the mixture is dissolved in a low boiling point organic solvent (e.g., ethyl acetate or methyl ethyl ketone). The resulting mixture may be added after it is dispersed in water by using an emulsion-dispersion method known in the field of this art. Also, the coupler and the developing agent can be added by a solid dispersion method described in JP-A-63-271339.

An auxiliary developing agent is preferably used in the present invention. Here, the auxiliary developing agent means a material having the ability of promoting the migration of electrons from the color-developing agent to the silver halide during silver halide development, and it is an electron-releasable compound pursuant to the Kendall-Perz Law. Given as examples of the auxiliary developing agent used in the present invention include the compounds represented by formula (B-1) or (B-2) explained in the specification of JP-A-9-152705, pp37–38; and sulfonamidophenol compounds represented by formula (I) explained in the specification of JP-A-9-146248, pp3–6. Specific examples of compounds of these auxiliary developing agent include the compounds (ETA-1) to (ETA-36) described in the specification of JP-A-9-152705, pp39–41; and the compounds D-1 to D-35 described in the specification of JP-A-9-146248, pp9–15.

In the present invention, a compound that, when silver ions are reduced to silver under high temperature conditions, releases a diffusion dye correspondingly to this reaction, that is, a dye-providing compound can be used.

Examples of the dye-providing compound include compounds having a function of releasing a diffusion dye imagewise. The compounds of this type can be represented by the following formula (LI):

$$((\text{Dye})m—Y)n—Z \qquad (LI)$$

Dye represents a dye group or a dye precursor group, or a dye group or a dye precursor group whose wavelength is temporarily shortened; Y represents a single bond or a linking group, z represents a group which has such a property that produces a difference in the diffusibility of the compound represented by ((Dye)m—Y)n—Z correspondingly to the light-sensitive silver salt having a latent image imagewise, or that releases (Dye)m—Y, to produce a difference in the diffusibility between (Dye)m—Y released and ((Dye)m—Y)n—Z; m is an integral number of 1 to 5, n is 1 or 2, and when m or n is not 1, a plurality of Dyes are the same or different. More specifically, the following compounds (1) and (2) are mentioned.

Compound (1) is a coupler (DDR coupler) having a diffusion dye, as a coupling split-off group, and it is a non-diffusion compound itself that can release a diffusion dye upon reaction with the oxidized product of a reducing agent. Specific examples include those described, for example, in Great Britain Patent No. 1,330,524, JP-B-48-39165, U.S. Pat. No. 3,443,940, U.S. Pat. No. 4,474,867, and U.S. Pat. No. 4,483,914.

Compound (2) is a non-diffusion compound itself (DRR compound) that can reduce silver halides or organosilver salts and can release a diffusible dye upon reducing them. Typical examples thereof include those described, for example, in U.S. Pat. No. 3,928,312, U.S. Pat. No. 4,053,312, U.S. Pat. No. 4,055,428, U.S. Pat. No. 4,336,322, JP-A-56-65839, JP-A-59-69839, JP-A-53-3819, JP-A-51-104343, RD No. 17,465, U.S. Pat. No. 3,725,062, U.S. Pat. No. 3,728,113, U.S. Pat. No. 3,443,939, JP-A-58-116537, JP-A-57-179840, and U.S. Pat. No. 4,500,626.

As specific examples of the DRR compound, compounds described in the above U.S. Pat. No. 4,500,626, columns 22 to 44, can be mentioned, and in particular, compounds (1) to (3), (10) to (13), (16) to (19), (28) to (30), (33) to (35), (38) to (40), and (42) to (64) described in the above US patent are preferable. Compounds described in U.S. Pat. No. 4,639,408, columns 37 to 39, are also useful.

In addition, as dye-providing compounds other than the above-described couplers and those represented by formula (LI), for example, dye silver compounds formed by combining an organosilver salt with a dye (in, for example, Research Disclosure, May, 1978, pages 54 to 58), azo dyes used in the heat-development silver dye bleach process (in, for example, U.S. Pat. No. 4,235,957 and Research Disclosure, April, 1976, pages 30 to 32), and leuco dyes (in, for example, U.S. Pat. No. 3,985,565 and U.S. Pat. No. 4,022,617) can be used.

Hydrophobic additives used in the present invention, such as dye-providing (dye-donative) compounds, nondiffusion reducing agents, color-developing agents and couplers, can be introduced into photographic constitutional layers of a heat-developable photographic material by a known method, such as the one described in U.S. Pat. No. 2,322,027. In this case, use can be made of a high-boiling organic solvent as described, for example, in U.S. Pat. No. 4,555,470, U.S. Pat. No. 4,536,466, U.S. Pat. No. 4,536,467, U.S. Pat. No. 4,587,206, U.S. Pat. No. 4,555,476, U.S. Pat. No. 4,599,296, and JP-B-3-62256, if necessary, in combination with a low-boiling organic solvent having a boiling point of 50 to 160° C. These dye-providing compounds, nondiffusion reducing agents, high-boiling organic solvents, and the like can be used in the form of a combination of two or more.

The high-boiling organic solvent is used in an amount of generally 10 g or less, preferably 5 g or less, and more preferably 1 g to 0.1 g, per g of the dyeproviding compound to be used. The amount is also generally 1 ml or less, preferably 0.5 ml or less, and more preferably 0.3 ml or less, per g of the binder. A dispersion method that uses a polymer, as described in JP-B-51-39853 and JP-A-51-59943, and a method wherein the addition is made with them in the form of a dispersion of fine particles, as described, for example, in JP-A-62-30242, can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used are listed in JP-A-59-157636, pages (37) to (38), and in the Research Disclosure (RD) publications shown above.

In the heat-developable light-sensitive material for use in the present invention, use can be made of a compound that can activate the development and can make the image stable. Preferable specific compounds for use are described in U.S. Pat. No. 4,500,626, the 51st column to the 52nd column.

In the system for forming an image by diffusion transfer of a dye, various compounds can be added to the constitutional layers of the heat-developable light-sensitive material for use in the present invention, for the purpose of fixing unnecessary dyes or colored substances or rendering them colorless, to improve the white background of the resulting image.

Specifically, compounds described in EP-A-353 741, EP-A-461 416, JP-A-63-163345, and JP-A-62-203158 can be used.

For the constitutional layers of the heat-developable light-sensitive material for use in the present invention, various pigments and dyes can be used for the purpose of improving color separation and making sensitivity high.

Specifically, compounds described in the above Research Disclosures, and compounds and layer structures described, .for example, in EP-A-479 167, EP-A-502 508, JP-A-1-167838, JP-A-4-343355, JP-A-2-168252, JP-A-61-20943, EP-A-479 167, and EP-A-502 508 can be used.

In the system wherein an image is formed by diffusion transfer of a dye, a dye-fixing material is used together with the heat-developable light-sensitive material. The dye-fixing material may be either in the form wherein the dye-fixing material is applied on a base different from that of the light-sensitive material, or in the form wherein the dye-fixing material is applied on the same base as that of the light-sensitive material. As for the mutual relationship of the light-sensitive material to the dye-fixing material, and the relationship thereof to the base, and to the white reflective layer, the relationship described in U.S. Pat. No. 4,500,626, column 57, can also be applied to the present invention.

The dye-fixing material preferably used in the present invention has at least one layer containing a mordant and a binder. As the mordant, one known in the field of photography can be used, and specific examples thereof include mordants described in U.S. Pat. No. 4,500,626, columns 58 to 59, JP-A-61-88256, pages (32) to (41), and JP-A-1-161236, pages (4) to (7), and those described, for example, in U.S. Pat. No. 4,774,162, U.S. Pat. No. 4,619,883, and U.S. Pat. No. 4,594,308. Further, dye-accepting polymer compounds as described in U.S. Pat. No. 4,463,079 may be used.

The binder used in the dye-fixing material for use in the present invention is preferably the above hydrophilic binder. Further, the additional use of carrageenans, as described in EP-A-443 529, and latexes having a glass transition temperature of 40° C. or less, as described in JP-B-3-74820, is preferable.

The dye-fixing material may be provided, if necessary, with an auxiliary layer, such as a protective layer, a release (split-off) layer, an undercoat layer, an intermediate layer, a backing layer, and a curling-preventive layer. Particularly, the provision of a protective layer is useful. Further, a undercoat layer, a protective layer, and so on, may be added to the backing layer For the constitutional layers of the heat-developable light-sensitive material and the dye-fixing material, use can be made of a plasticizer, a slip agent, or a high-boiling organic solvent as a releasability improver between the light-sensitive material and the dye-fixing material. Specifically, those described, for example, in the above Research Disclosures and JP-A-62-245253 can be mentioned.

Further, for the above purpose, a variety of silicone oils (all silicone oils including dimethylsilicone oils and modified silicone oils formed by introducing various organic groups into dimethylsiloxanes) can be used. For example, various modified silicone oils described in "Hensei Silicone Oils," Gijyutsu Shiryo, P6 to 18B, published by Shinetsu Silicone K. K., and particularly carboxy-modified silicone (trade name: X-22-3710) are effective.

Further, silicone oils described in JP-A-62-215953 and JP-A-63-46449 are also effective.

In the heat-developable light-sensitive material and the dye-fixing material, an anti-fading (anti-discoloring) agent may be used. As the anti-fading agent, can be mentioned, for example, an antioxidant, an ultraviolet absorber, or a certain type of metal complex, and, for example, ultraviolet absorbers and dye-image stabilizers described in the above Research Disclosures are also useful.

As the antioxidant, there are, for example, chroman-series compounds, coumaran-series compounds, phenol-series compounds (e.g., hindered phenols), hydroquinone derivatives, hindered amine derivatives, and spiroindane-series compounds. Further, compounds described in JP-A-61-159644 are also effective.

As the ultraviolet absorber, there are benzotriazole-series compounds (U.S. Pat. No. 3,533,794 etc.), 4-thiazolidone-series compounds (U.S. Pat. No. 3,352,681 etc.), and benzophenone-series compounds (JP-A-46-2784 etc.), as well as compounds described, for example, in JP-A-54-48535, JP-A-62-136641, and JP-A-61-88256. Further, ultraviolet absorbable polymers described in JP-A-62-260152 are also effective.

As the metal complex, there are compounds described, for example, in U.S. Pat. No. 4,241,155, U.S. Pat. No. 4,245,018 in columns 3 to 36, U.S. Pat. No. 4,254,195 in columns 3 to 8, JP-A-62-174741, JP-A-61-88256 on pages (27) to (29), JP-A-63-199248, JP-A-1-75568, and JP-A-1-74272.

The anti-fading agent for preventing the dye transferred to the dye-fixing material from fading may be contained previously in the dye-fixing material, or it may be supplied to the dye-fixing material from the outside, for example, from the heat-developable light-sensitive material or the later-described transfer solvent.

The above antioxidants, ultraviolet absorbers, and metal complexes may be used in combination each other.

In the heat-developable light-sensitive material and the dye-fixing material, a fluorescent whitening agent may be used. Particularly preferably, the fluorescent whitening agent is built in the dye-fixing material or it is supplied from the outside, for example, from the heat-developable light-sensitive material or the transfer solvent. As examples thereof, can be mentioned compounds described, for example, in "The Chemistry of Synthetic Dyes," Vol. V, Section 8, edited by K. Veenkataraman and in JP-A-61-143752. More specifically, for example, stilbene-series compounds, coumarin-series compounds, biphenyl-series compounds, benzoxazolyl-series compounds, naphthalimide-series compounds, pyrazoline-series compounds, and carbostyryl-series compounds can be mentioned.

The fluorescent whitening agent can be used in combination with the anti-fading agent or the ultraviolet absorber.

Specific examples of these anti-fading agent, ultraviolet absorber, and fluorescent whitening agent are described in JP-A-62-215272, pages (125) to (137), and JP-A-1-161236, pages (17) to (43).

Examples of the hardening agent that is used in constitutional layers of the heat-developable light-sensitive material or the dye-fixing material, include hardening agents described, for example, in the above Research Disclosures, U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis (vinylsulfonylacetamido)ethane, etc.), an N-methylol-series hardening agent (dimethylol urea, etc.), or a polymer hardening agent (compounds described, for example, in JP-A-62-234157), can be mentioned.

These hardening agents are used in an amount of generally 0.001 to 1 g, and preferably 0.005 to 0.5 g, per g of the gelatin coated. The layer into which the hardeners are added may be any of layers that constitute the photographic material or the dye-fixed material, or the hardener may be divided into two or more parts, which are added into two or more layers.

In the constitutional layers of the heat-developable photographic material or the dye-fixing material, various anti-foggants or photographic stabilizers and their precursors can be used. Specific examples thereof include compounds described, for example, in the above-mentioned Research Disclosures, U.S. Pat. No. 5,089,378, U.S. Pat. No. 4,500,627, U.S. Pat. No. 4,614,702, JP-A-62-13546 (pages (7) to (9), (57) to (71), and (81) to (97)), U.S. Pat. No. 4,775,610, U.S. Pat. No. 4,626,500, and U.S. Pat. No. 4,983,494, JP-A-62-174747, JP-A-62-239148, JP-A-63-264747, JP-A-1-150135, JP-A-2-110557, JP-A-2-178650, and Research Disclosure No. 17,643 (1978), pages (24) to (25).

These compounds are preferably used in an amount of $5\times10^{-6}$ to $1\times10^{-1}$ mol, and more preferably $1\times10^{-5}$ to $1\times10^{-2}$ mol, per mol of silver.

In the constitutional layers of the heat-developable photographic material or dye-fixing material, use can be made of various surface-active agents for various purposes of, for example, serving as a coating aid, improving releasability and slipping property, preventing electrification, or accelerating development. Specific examples of the surface-active agents are described, for example, in the above Research Disclosures and JP-A-62-173463 and JP-A-62-183457.

In the constitutional layers of the heat-development photographic material or dye-fixing material, an organofluoro compound may also be contained, for example, for the purposes of improving slipping properties, preventing electrification, and improving releasability. Typical examples of the organofluoro compound include hydrophobic fluoro compounds, including solid fluoro compound resins, such as ethylene tetrafluoride resins, or oily fluoro compounds, such as fluoro oils; or fluorine-containing surface-active agents described, for example, in JP-B-57-9053, column 8 to column 17, JP-A-61-20944, and JP-A-62-135826.

In the heat-developable photographic material and the dye-fixing material, a matting agent can be used for the purpose of adhesion prevention, improvement of slipping property, matting, etc. Example matting agents include compounds, including silicon dioxide, polyolefins, polymethacrylates, and the like, as described in JP-A-61-88256, page (29), as well as compounds, including benzoguanamine resin beads, polycarbonate resin beads, ABS resin beads, and the like, described in JP-A-63-274944 and JP-A-63-274952. Other matting agents described in the above RD can be used. These matting agents are added into the uppermost layer (protective layer), and also into a lower layer if required.

Further, the constitutional layers of the heat-developable photographic material and the dye-fixing material may contain a heat solvent, an antifoaming agent, a germ-proofing agent, a mildew-proofing agent, colloidal silica, etc. Specific examples of these additives are described, for example, in JP-A-61-88256, pages (26) to (32); JP-A-3-11338, and JP-B-2-51496.

In the present invention, an image-formation-accelerating agent can be used in the heat-developable light-sensitive material and/or the dye-fixing material. Image-formation-accelerating agents function, for example, to accelerate the redox reaction between a silver salt oxidizing agent and a reducing agent, to accelerate a dye formation reaction from a dye-providing compound, a dye decomposition reaction, or a diffusion dye-releasing reaction, and to accelerate transfer of a dye from a layer of a heat-developable light-sensitive material to a dye-fixing layer. These agents are classified, from the physicochemical functional point of view, for example, into bases or base precursors, nucleophilic compounds, high-boiling organic solvents (oils), heat solvents, surfactants, and compounds interactive with silver or silver ions. However, generally these compounds have a composite function, and they usually possess some of the above acceleration effects in combination. The details thereof are described in U.S. Pat. No. 4,678,739, columns 38 to 40.

As the base precursor, for example, salts of organic acids with bases that will be decarboxylated by heat, as well as compounds that will release amines by intramolecular nucleophilic substitution reaction, Lossen rearrangement, or Beckman rearrangement, are mentioned. Specific examples thereof are described, for example, in U.S. Pat. Nos. 4,514,493 and 4,657,848.

In the system wherein the heat development and the transfer of the dye are carried out simultaneously in the presence of a small amount of water, a base and/or a base precursor is preferably contained in the dye-fixing material, with a view to increasing the preservability of the heat-developable light-sensitive material.

In addition to the above, combinations of hardly soluble metal compounds (that are hardly soluble in water) described in EP-A-210 660 and U.S. Pat. No. 4,740,445 with compounds capable of complex formation reaction with metal ions constituting these hardly soluble compounds (referred to as complex-forming compounds), and compounds capable of producing a base by electrolysis, as described in JP-A-61-232451, can also be used as the base precursor. Particularly the former means is effective. The hardly soluble metal compound and the complex-forming compound are advantageously added separately to the heat-developable light-sensitive material and the dye-fixing element, as described in the above patent publications.

In the heat-developable photographic material and/or the dye-fixing material for use in the present invention, in order to obtain a constant image all the time, against fluctuation of the processing temperature and the processing time at the time of development, various development-stopping agents can be used.

Herein, the term "a development-stopping agent" means a compound that neutralizes bases quickly or reacts quickly with bases after suitable development, to lower the base concentration in the film, to stop the development; or a compound that interacts with silver and silver salts, to inhibit the development. Specific examples include acid precursors that release an acid when heated, electrophilic compounds that undergo a substitution reaction with coexisting bases when heated, nitrogen-containing heterocyclic compounds, mercapto compounds, and their precursors. Details are described in JP-A-62-253159, pages (31) to (32).

As the base (support) of the heat-developable light-sensitive material and the dye-fixing material in the present invention, those that can withstand the processing temperature are used. Generally, photographic bases, such as papers and synthetic polymers (films) described in "Shashin Kogaku no Kiso—Ginen Shashin-hen—," edited by Nihon Shashin-gakkai and published by Korona-sha, 1979, pages (223) to (240), can be mentioned. Specifically, use is made of polyethylene terephthalates, polyethylene naphthalates, polycarbonates, polyvinyl chlorides, polystyrenes, polypropylenes, polyimides, celluloses (e.g., triacetylcellulose); those obtained by incorporating a pigment, such as titanium oxide, into films made of these; synthetic papers made from polypropylenes and the like by the film method; papers made by mixing synthetic resin pulps, for example, of polyethylenes, with natural pulp; Yankee paper, baryta paper, coated papers (particularly, cast-coated paper), metals, cloths, glasses, etc.

These may be used singly or may be used in the form of a base one or both of whose surfaces are laminated with a synthetic polymer, such as polyethylenes. This laminate layer can be previously formed to contain, if necessary, a dye or a pigment, such as titanium oxide, ultramarine, and carbon black.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

The backing surface of these bases may be coated with a hydrophilic binder plus a semiconductive metal oxide, such as tin oxide and alumina sol, carbon black, and another antistatic agent. Specifically, bases described, for example, in JP-A-63-220246 can be used.

Further, preferably the surface of the base is -subjected to various surface treatments or it is provided with various undercoats, for the purpose of improving the adhesion to the hydrophilic binder.

The heat-developable light-sensitive material and/or the dye-fixing material for use in the present invention may be in the form that has an electroconductive heat-generating material layer as heating means for heat development and diffusion transfer of the dye. In this case, as the heat-generating element, one described, for example, in JP-A-61-145544 can be employed.

The heating temperature in the heat development process is generally about 50 to 250° C. and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature, and it is particularly preferably from 50° C. or more, to a temperature lower by about 10° C. than the heat development process.

The transfer of the dye can be brought about only by heat, but a solvent may be used to accelerate the dye transfer. Further, it is also useful to use a method described, for example, in U.S. Pat. No. 4,704,345, U.S. Pat. No. 4,740,445, and JP-A-61-238056, wherein the development and the transfer are carried out at the same time or successively by heating in the presence of a small amount of a solvent (particularly water). In this system, the heating temperature is preferably 50° C. or more to at the most the boiling point of the solvent, and for example, in the case wherein the solvent is water, the heating temperature is preferably 50° C. to 100° C.

Examples of the solvent that is used for acceleration of the development and/or for diffusion transfer of dyes include water, an aqueous basic solution containing an inorganic alkali metal salt or an organic base (as the base, those described in the section of image formation-accelerating agents can be used), a low-boiling solvent, and a mixed solution of a low-boiling solvent with water or the above-mentioned aqueous basic solution. Also, a surface-active agent, an antifoggant, a complex-forming compound with a hardly-soluble metal salt, a mildew-proofing agent, and an antifungus agent may be contained in the solvent.

As the solvent to be used in these heat development and diffusion transfer steps, water is preferably used, and the water may be any water that is generally used. Specifically, for example, distilled water, tap water, well water, and mineral water can be used. In the heat-developable apparatus in which the heat-developable light-sensitive material for use in the present invention and the dye-fixing material are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-210555 may be used.

These solvents may be used in such a way that they are applied to the heat-developable light-sensitive material or the dye-fixing material, or to both of them. The amount of the solvent to be used may be the weight of the solvent corresponding to or below the maximum swell volume of the entire coated film.

As the method of applying water, for example, methods described in JP-A-62-253159, page (5), and JP-A-63-85544 are preferably used. Further, the solvent may be enclosed in microcapsules or may take the form of a hydrate, to be previously built into either or both of the heat-developable light-sensitive material and the dye-fixing material, for use.

The suitable temperature of the water to be applied is generally 30 to 60° C., as described, for example, in JP-A-63-85544, supra. It is particularly useful to make the temperature 45° C. or more, in view of prevention of propagation of bacteria in water.

To accelerate the dye transfer, a system can be adopted wherein a hydrophilic heat solvent that is solid at normal temperatures and melts at a higher temperature is built in the heat-developable light-sensitive material and/or the dye-fixing material. The layer wherein the hydrophilic heat solvent is built in may be any of the light-sensitive silver halide emulsion layer, the intermediate layer, the protective layer, and the dye-fixing layer, but preferably it is the dye-fixing layer and/or the layer adjacent thereto.

Examples of the hydrophilic heat solvent include ureas, pyridines, amides, sulfonamides, imides, alcohols, oximes, and other heterocyclic compounds.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere. Alternatively, the photographic material may be subjected to irradiation with a high-output laser to its entire surface, to provide heat.

As a method wherein the heat-developable light-sensitive material and the dye-fixing material are placed one upon the other, methods described in JP-A-62-253159, and JP-A-61-147244, on page (27), can be applied.

According to the present invention, the occurrence of uneven exposure density can be prevented in the formation of an image produced in a scanning exposure system using a plurality of exposure light-sources whose exposure time is $10^{-3}$ seconds or less per one exposure.

Next, the present invention is described in more detail based on the following Examples, but the invention is not limited to those.

EXAMPLE 1

Method of the production of a light-sensitive silver halide emulsion Light-sensitive silver halide emulsion (1) (for a red-sensitive emulsion layer)

A solution (I) shown in Table 1 was added to a well-stirred aqueous gelatin solution (a solution in which 600 g of gelatin, 180 g of sodium chloride, 28 g of citric acid and 96 ml of an aqueous 1% solution of a compound (a) were added to 39 liters of water and which was kept at 45° C.) at a constant flow rate for 9 minutes, and a solution (II) was also started to add at the same time with the solution (I) at a constant flow rate for 10 minutes. After five minutes, a solution (III) shown in Table 1 was further added at a constant flow rate for 10 minutes and at the same time, a solution (IV) was added at a constant flow rate for 10 minutes. Then 9.2 g of a sensitizing dye (al), 8.9 g of a sensitizing dye (a2) and 3.7 g of a sensitizing dye (a3) were added to the resulting mixture, followed by stirring at 45° C. for 8 minutes.

The obtained mixture was washed and desalted (at a pH of 3.3 by using a precipitating agent (b)) using a usual method. Thereafter, 1500 g of an ossein gelatin which had been treated with lime, 12 g of sodium chloride and 8.4 g of a compound (b) were added to the desalted mixture to be adjusted to pH 6.0. After the temperature of the resulting mixture was raised to 60° C., 49 g of sodium chloride, 640 mg of a compound (e), 123 mg of hypo and 140 mg of chloroauric acid were added to the resulting mixture to perform chemical sensitization for 15 minutes. Thereafter, 6.9 g of a sensitizing dye (a1) and 1.9 g of a sensitizing dye (a2) were added to the sensitized mixture, followed by stirring further for 35 minutes, to which were added 3.3 g of an antifoggant (1) and 163.5 g of a compound (C) sequentially, followed by cooling. Thus 38.4 kg of a monodispersion cubic silver chlorobromide emulsion having an average particle size of 0.24 μm was obtained.

TABLE 1

| | Solution (I) | Solution (II) | Solution (III) | Solution (IV) |
|---|---|---|---|---|
| $AgNO_3$ | 3000 g | none | 3000 g | none |
| KBr | None | 1051 g | none | 1050 g |
| NaCl | None | 714 g | none | 515 g |
| $(NH_4)_3RhCl_5.H_2O$ | None | 2 mg | none | none |
| Yellow prussiate of potash | None | none | none | 0.3 g |
| Water to make | 10740 ml | 12750 ml | 5280 ml | 7760 ml |

Compound (a)

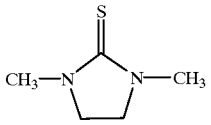

Compound (b)

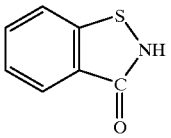

Compound (c)

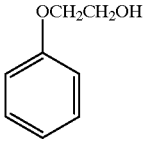

Compound (e)

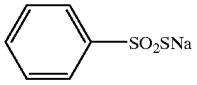

Dye (a1)

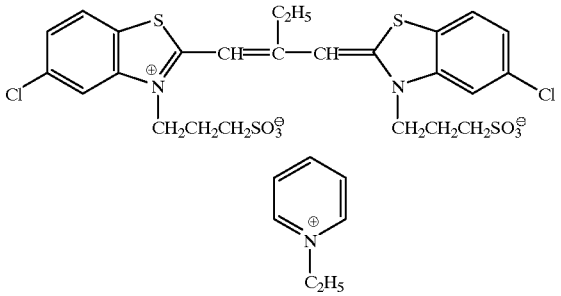

TABLE 1-continued

| | Solution (I) | Solution (II) | Solution (III) | Solution (IV) |
|---|---|---|---|---|

Dye (a2)

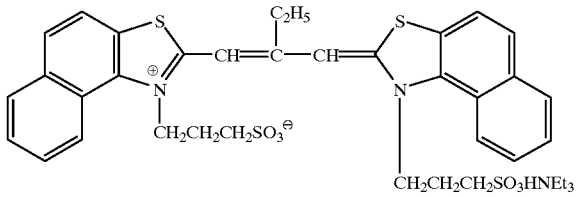

Dye (a3)

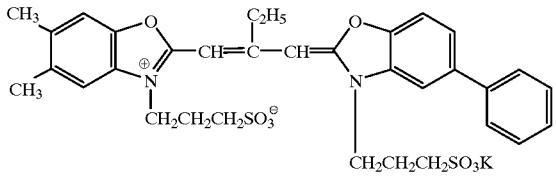

Settling agent (b)

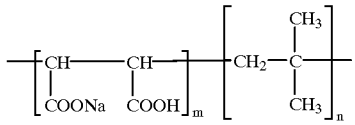

m + n= 1

Antifoggant (1)

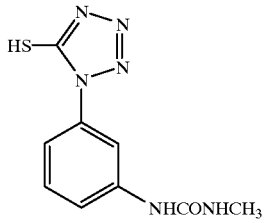

Light-sensitive silver halide emulsion (2) (for a green-sensitive emulsion layer)

A solution (I) shown in Table 2 was added to a well-stirred aqueous gelatin solution (a solution in which 630 g of gelatin, 189 g of sodium chloride, 30 g of citric acid and 63 ml of an aqueous 1% solution of a compound (a) were added to 41 liters of water and which was kept at 45° C.) at a constant flow rate for 24 minutes, and a solution (II) was also added at the same time at a constant flow rate for 24 minutes. After five minutes, a solution (III) shown in Table 2 was further added at a constant flow rate for 15 minutes and at the same time, a solution (IV) was added at a constant flow rate for 15 minutes. Then 2.7 g of a sensitizing dye (b1), 0.6 g of a sensitizing dye (b2), 11.2 g of a sensitizing dye (b3) and 4.7 g of a sensitizing dye (b4) were added to the resulting mixture, followed by stirring at 45° C. for 8 minutes.

The obtained mixture was washed and desalted (at a pH of 3.3 by using a precipitating agent (b)) using a usual method. Thereafter, 1500 g of an ossein gelatin which had been treated using lime, 13 g of sodium chloride and 4.4 g of a compound (b) were added to the desalted mixture to be adjusted to pH 6.1. After the temperature of the resulting mixture was raised to 60° C., 180 g of sodium chloride, 800 mg of a compound (e), 60 mg of hypo and 134 mg of chloroauric acid were added to the resulting mixture to perform chemical sensitization for 40 minutes. Thereafter, 2.7 g of an antifoggant (2) and 134 g of a compound (C) were added sequentially, followed by cooling. Thus 38.4 kg of a monodispersion cubic silver chlorobromide emulsion having an average particle size of 0.30 μm was obtained.

TABLE 2

| | Solution (I) | Solution (II) | Solution (III) | Solution (IV) |
|---|---|---|---|---|
| $AgNO_3$ | 3150 g | none | 3150 g | none |
| KBr | None | 772 g | none | 1120 g |
| NaCl | None | 878 g | none | 602 g |
| $(NH_4)_3RhCl_5.H_2O$ | None | 1.5 mg | none | none |
| $K_2IrCl_6$ | None | 5 mg | none | none |
| Water to make | 14175 ml | 14175 ml | 15120 ml | 15120 ml |

Dye (b1)

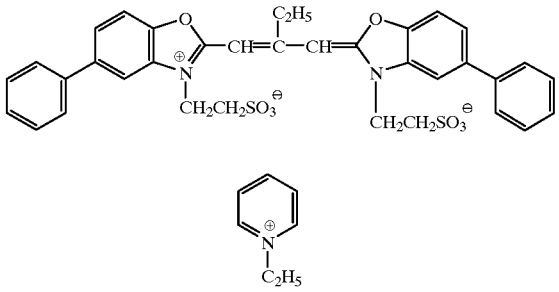

Dye (b2)

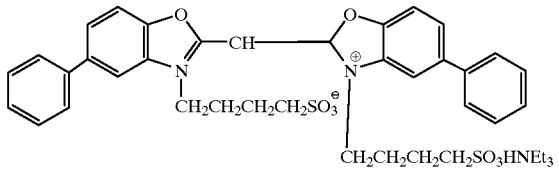

Dye (b3)

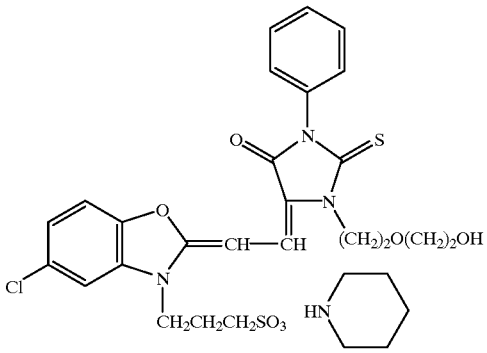

Dye (b4)

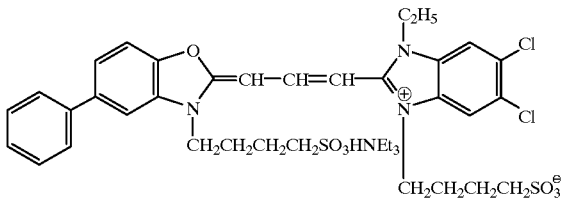

TABLE 2-continued

| | Solution (I) | Solution (II) | Solution (III) | Solution (IV) |
|---|---|---|---|---|

Antifoggant (2)

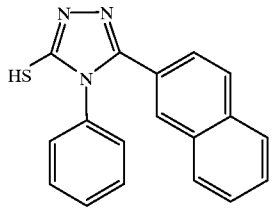

Light-sensitive silver halide emulsion (3) (for a blue-sensitive emulsion layer)

A solution (I) shown in Table 3 was added to a well-stirred aqueous gelatin solution (a solution in which 1280 g of gelatin, 128 g of sodium chloride, 19.2 g of potassium bromide, 992 ml of sulfuric acid (1N) and 192 ml of an aqueous 1% solution of a compound (a) were added to 34.7 liters of water and which was kept at 50° C.) at a constant flow rate for 30 minutes, and a solution (II) was also added at the same time at a constant flow rate for 30 minutes. After five minutes, a solution (III) shown in Table 3 was further added at a constant flow rate for 24 minutes and, a solution (IV) was started to add at the same time with the solution (III) at a constant flow rate for 25 minutes. Then 10 g of a sensitizing dye (c1) and 10 g of a sensitizing dye (c2) were added to the resulting mixture, followed by stirring at 50° C. for 15 minutes.

The obtained mixture was washed and desalted (at a pH of 3.7 by using a precipitating agent (a)) using a usual method. Thereafter, 1408 g of an ossein gelatin which had been treated using lime, 19.2 g of sodium chloride and 4.5 g of a compound (b) were added to the desalted mixture to be adjusted to pH 7.4. After the temperature of the resulting mixture was raised to 60° C., 3 g of a sensitizing dye (c3), 7.9 g of 4-hydroxy-6-methyl- 1,3,3a,7-tetrazinedene, 178 mg of trimethylthiourea and 134 mg of chloroauric acid were added to the resulting mixture to perform chemical sensitization for 40 minutes. Thereafter, 7.9 g of 4-hydroxy-6-methyl-1,3,3a,7-tetrazinedene was added again, to which were further added 7.9 g of an antifoggant (3) and 198 g of a compound (C) sequentially, followed by cooling. Thus 45 kg of a monodispersion cubic silver chlorobromide emulsion having an average particle size of 0.35 μm was obtained.

TABLE 3

| | Solution (I) | Solution (II) | Solution (III) | Solution (IV) |
|---|---|---|---|---|
| $AgNO_3$ | 1920 g | none | 4480 g | none |
| KBr | none | 873 g | none | 2824 g |
| NaCl | none | 231 g | none | 155 g |
| Yellow prussiate of potash | none | none | none | 2.6 g |
| Water to make | 11520 ml | 11584 ml | 15936 ml | 16384 ml |

Settling agent (a)

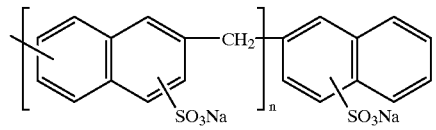

TABLE 3-continued

| | Solution (I) | Solution (II) | Solution (III) | Solution (IV) |
|---|---|---|---|---|

Antifoggant (3)

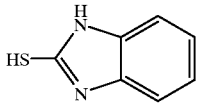

Dye (c1)

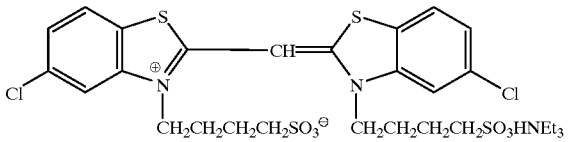

Dye (c2)

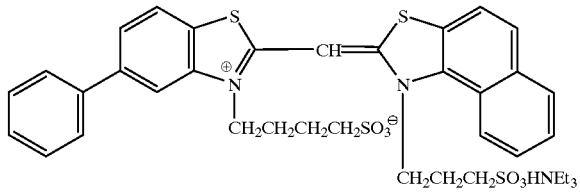

Dye (c3)

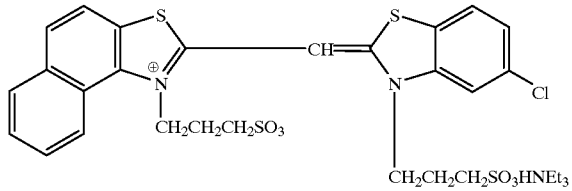

(Et represents an enthy group.)

Next, the preparation method of a dispersion of zinc hydroxide is described.

12.5 g of zinc hydroxide with an average particle size of 0.2 μm, 0.1 g of poly(sodium acrylate), and 1 g of carboxymethylcellulose, as a dispersant, were added to 100 ml of a 4% aqueous gelatin solution, and the grinding was carried out for 30 min in a mill using glass beads with an average particle diameter of 0.75 mm. Then the glass beads were separated, to obtain a dispersion of zinc hydroxide.

A method of the preparation of a gelatin dispersion of a hydrophobic additive will be explained.

Each gelatin dispersion of a yellow dye-donating compound, a magenta dye-donating compound, or a cyan dye-donating compound was prepared according to the formulation shown in Table 4. Specifically, each oil phase component was heated to about 70° C. to be dissolved thereby forming a homogeneous solution. The water phase component heated to about 60° C. was added to this solution, which was mixed with stirring. The resulting mixture was then dispersed for 10 minutes at 10000 rpm in a homogenizer. Water was added to the dispersed mixture, which was then stirred to obtain a uniform dispersion.

TABLE 4

Composition of dispersion

| | Yellow | Magenta | Cyan |
|---|---|---|---|
| Cyan dye-providing compound (1) | none | none | 457.4 g |
| Magenta coupler (1) | none | 191.70 g | none |
| Color-developing agent (1) | none | 191.70 g | none |
| Magenta dye-providing compound (1) | none | 95.3 g | none |
| Yellow coupler (1) | 279.0 g | none | none |
| Color-developing agent (2) | 279.0 g | none | none |
| Compound (h) | 26.8 g | 5.4 g | 26.2 g |
| Compound (d) | 69.8 g | none | none |
| Compound (Q) | 3.3 g | 3.3 g | none |
| Compound (m) | none | 5.4 g | none |
| Surface active agent (1) | 26.3 g | 10.0 g | 19.6 g |
| Compound (p) | 39.9 g | 20.5 g | 38.0 g |
| Compound (o) | none | 20.5 g | none |
| High-boiling solvent (2) | 279.0 g | 239.6 g | 77.4 g |
| High-boiling solvent (1) | none | none | 179.7 g |
| Compound (i) | none | none | 54.5 g |
| Water | none | none | 27.2 ml |
| Ethyl acetate | 1457.4 ml | 779 ml | 653.4 ml |
| Lime-processed gelatin | 311.8 g | 262.4 g | 261.4 g |
| Zinc nitrate | none | 11.2 g | none |
| Water | 4717.2 ml | 3887.6 ml | 3703.5 ml |
| Additional water | 3047.6 ml | 4496.9 ml | 5457.4 ml |
| Compound (b) | 1.4 g | 1.1 g | 1.1 g |

Cyan dye providing compound (1)

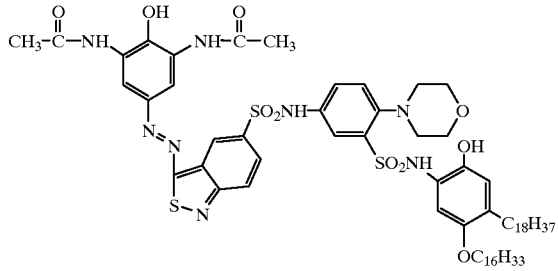

Magenta coupler (1)

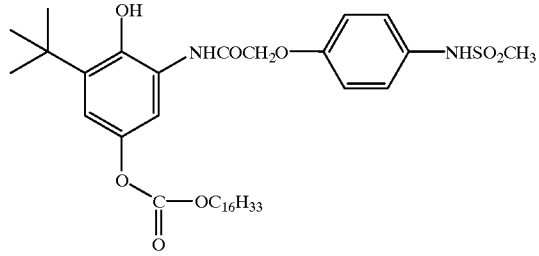

Color-developing agent (1)

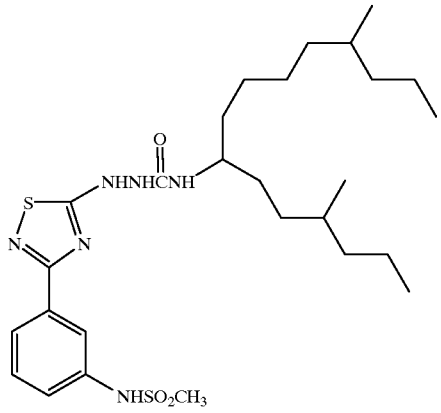

TABLE 4-continued

| Composition of dispersion | Yellow | Magenta | Cyan |
|---|---|---|---|
| Magenta dye providing compound (1) | | | |
| Yellow coupler (1) | | | |
| Color-developing agent (2) | | | |

TABLE 4-continued

| Composition of dispersion | Yellow | Magenta | Cyan |
|---|---|---|---|
| Compound (h) | | | |
| Compound (d) | | | |
| Compound (Q) | | | |
| Compound (m) | | | |
| Surfactant (1) | | | |
| Compound (p) | | | |

TABLE 4-continued

Composition of dispersion

| | Yellow | Magenta | Cyan |
|---|---|---|---|

Compound (o)

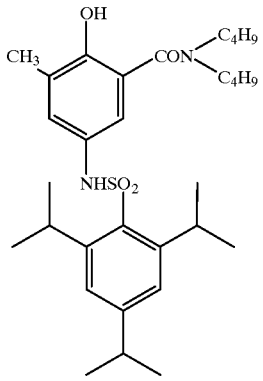

High-boiling organic solvent (1)

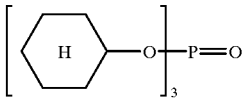

High-boiling organic solvent (2)

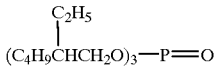

Compound (i)

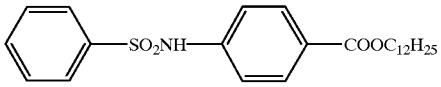

A gelatin dispersion of a compound (d) and a dye (A) was prepared according to the formulation shown in Table 5. Specifically, each oil phase component was heated to about 60° C. to be dissolved thereby forming a homogeneous solution. The water phase component heated to about 60° C. was added to this solution, which was mixed with stirring. The resulting mixture was then dispersed for 10 minutes at 10000 rpm in a homogenizer. Water was added to the dispersed mixture, which was then stirred to obtain a uniform dispersion.

TABLE 5

Composition of dispersion

| | Antifoggant | Dye |
|---|---|---|
| Compound (d) | 76.8 g | 38.4 g |
| Dye (A) | none | 406.6 g |
| Compound (h) | 10.1 g | 10.1 g |
| Compound (n) | none | 226.40 g |
| Compound (f) | 23.24 g | 23.24 g |
| High-boiling solvent (1) | 229.2 g | 229.2 g |
| Surfactant (1) | 48.0 g | 48.0 g |
| Compound (g) | 47.5 g | 47.5 g |
| Ethyl acetate | 1010.2 ml | 1010.2 ml |
| Lime-processed gelatin | 1010.2 g | 1010.2 g |
| Water | 5303.8 ml | 5303.8 ml |
| Additional water | 2830.0 ml | 2235.4 ml |
| Compound (b) | 4.4 g | 4.4 g |

The above materials were used to apply onto a support in accordance with the structure and amount to be added described in Table 6, to produce a light-sensitive material 101.

TABLE 6

Main materials constituting light-sensitive material 101

| | Name of layer | Additive | Added amount ($mg/m^2$) |
|---|---|---|---|
| Seventh layer | Acid-processed Protective layer | gelatin | 335 |
| | | Matting agent | 19 |
| | | Surfactant (2) | 4.9 |
| | | Surfactant (4) | 130 |
| | | Surfactant (3) | 65 |
| | | Calcium nitrate | 4.6 |
| Sixth layer | Intermediate layer | Lime-processed gelatin | 510 |
| | | Compound (d) | 22 |
| | | Compound (h) | 3.0 |
| | | High-boiling solvent (1) | 67 |
| | | Compound (f) | 6.8 |
| | | Compound (g) | 14 |
| | | Surfactant (1) | 14 |
| | | Calcium nitrate | 8.2 |
| | | Water-soluble polymer (1) | 6.1 |
| Fifth layer | Blue-light-sensitive layer | Lime-processed gelatin | 403 |
| | | Light-sensitive silver halide emulsion (3) | in terms of silver 351 |
| | | Yellow coupler (1) | 159 |
| | | Color-developing agent (2) | 159 |
| | | Compound (Q) | 2 |
| | | Compound (d) | 40 |
| | | Compound (h) | 15 |
| | | High-boiling solvent (2) | 16 |
| | | Compound (p) | 30 |
| | | Surfactant (1) | 15 |
| Forth layer | Intermediate layer | Lime-processed gelatin | 450 |
| | | Compound (d) | 11 |
| | | Dye (A) | 106 |
| | | Compound (h) | 2.8 |
| | | Compound (n) | 64 |
| | | High-boiling solvent (1) | 64 |
| | | Compound (f) | 6.5 |
| | | Zinc hydroxide | 340 |
| | | Compound (g) | 13 |
| | | Surfactant (1) | 13 |
| | | Surfactant (4) | 21 |
| | | Surfactant (3) | 1.0 |
| | | Calcium nitrate | 7.0 |
| | | Potassium bromide | 3.5 |
| | | Water-soluble polymer (1) | 31 |
| Third layer | Green-light-sensitive layer | Lime-processed gelatin | 444 |
| | | Light-sensitive silver halide emulsion (2) | in terms of silver 462 |
| | | Magenta coupler (1) | 165 |
| | | Color-developing agent (1) | 165 |
| | | Magenta-dye providing compound (1) | 41 |
| | | Compound (Q) | 2.6 |
| | | Compound (m) | 4.3 |
| | | Zinc hydroxide | 8.9 |
| | | Compound (h) | 4.3 |
| | | High-boiling solvent (2) | 190 |
| | | Compound (p) | 16 |
| | | Compound (o) | 16 |
| | | Surfactant (1) | 8.6 |
| | | Water-soluble polymer (1) | 17 |
| Second layer | Intermediate layer | Lime-processed gelatin | 587 |
| | | Compound (d) | 18 |
| | | Dye (A) | 173 |
| | | Compound (h) | 4.6 |
| | | Compound (n) | 104 |
| | | High-boiling solvent (1) | 105 |
| | | Compound (f) | 11 |
| | | Zinc hydroxide | 555 |
| | | Compound (g) | 22 |
| | | Surfactant (1) | 22 |
| | | Surfactant (4) | 34 |

TABLE 6-continued

Main materials constituting light-sensitive material 101

| | Name of layer | Additive | Added amount ($mg/m^2$) |
|---|---|---|---|
| | | Surfactant (3) | 1.5 |
| | | Calcium nitrate | 11 |
| | | Potassium bromide | 5.7 |
| | | Water-soluble polymer (1) | 50 |
| First layer | Red-light-sensitive layer | Lime-processed gelatin | 353 |
| | | Light-sensitive silver halide emulsion (1) | in terms of silver 179 |
| | | Cyan dye-providing compound (1) | 307 |
| | | Stabilizer | 4.1 |
| | | Compound (h) | 18 |
| | | High-boiling solvent (1) | 121 |
| | | High-boiling solvent (2) | 52 |
| | | Compound (i) | 37 |
| | | Compound (p) | 26 |
| | | Surfactant (1) | 13 |
| | | Water-solubie polymer (1) | 7.4 |
| | | Hardener (1) | 35 |
| Support (polyethylene-laminated paper support; thickness 131 μm) | | | |

Dye (A)

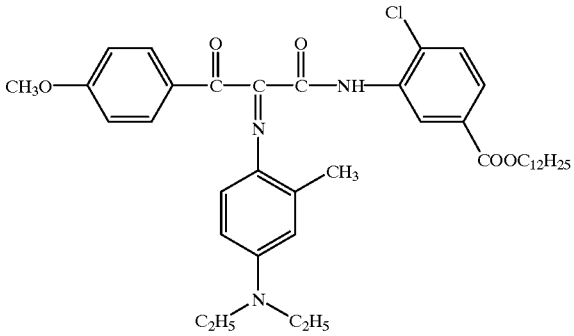

Compound (n)

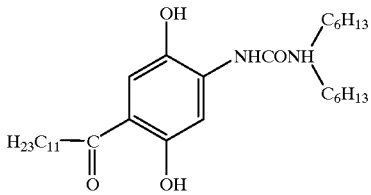

Compound (f)

$C_{26}H_{46.9}—Cl_{7.1}$

Compound (g)

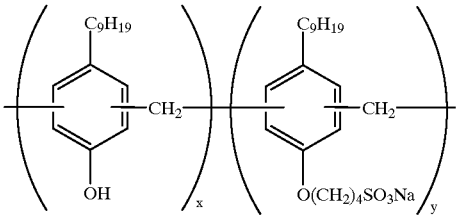

x + y = 58/42

TABLE 6-continued

Main materials constituting light-sensitive material 101

| Name of layer | Additive | Added amount ($mg/m^2$) |
|---|---|---|

Water-soluble polymer (1)

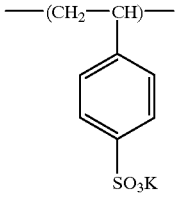

Hardener (1)

$CH_2=CH—SO_2CH_2SO_2CH=CH_2$

Stabilizer

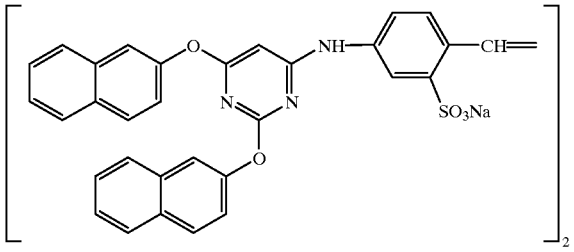

Surfactant (2)

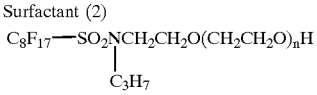

n = 15

Surfactant (3)

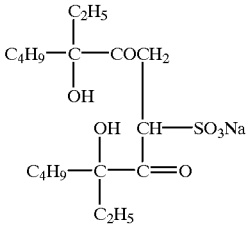

Surfactant (4)

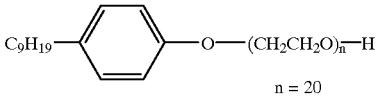

n = 20

Next, a method of the production of an image-receiving material will be mentioned.

An image-receiving material R201 having the structure as shown in Tables 7 and 8 was made.

A mordant (2) is a reaction product of a mordant (1) and an antifading agent (1). As to a method for the production of the mordant (2), firstly was added a powder of the antifading agent (1) in an amount of 0.4 mmol %, to an aqueous 25% solution of the mordant (1), and the resultant mixture was stirred at 60° C. for 3 hours, to form the mordant (2).

TABLE 7

Constitution of Image Receiving Element R201

| Number of layer | Additive | Coated amount ($mg/m^2$) |
|---|---|---|
| Sixth layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-preventing agent (1) | 7 |
| | Stain-preventing agent (2) | 12 |
| | Matting agent (1) | 7 |
| Fifth layer | Gelatin | 250 |
| | Water-soluble polymer (1) | 25 |
| | Anionic surfactant (3) | 9 |
| | Hardener (1) | 185 |
| Forth layer | Mordant (1) | 1850 |
| | Water-soluble polymer (2) | 260 |
| | Water-soluble polymer (4) | 1400 |
| | Dispersion of latex (1) | 600 |
| | Anionic surfactant (3) | 25 |
| | Nonionic surfactant (1) | 18 |
| | Guanidine picolinate | 2550 |
| | Sodium quinolinate | 350 |
| Third layer | Gelatin | 370 |
| | Mordant (1) | 300 |
| | Anionic surfactant (3) | 12 |
| Second layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | High-boiling organic solvent (1) | 700 |
| | Brightening agent (1) | 30 |
| | Stain-preventing agent (3) | 32 |
| | Guanidine picolinate | 360 |
| | Potassium quinolinate | 45 |
| First layer | Gelatin | 280 |
| | Water-soluble polymer (1) | 12 |
| | Anionic surfactant (1) | 14 |
| | Sodium metaborate | 35 |
| | Hardener (1) | 185 |
| Base (1) | Polyethylene-Laminated Paper Support | (thickness 215 μm) |

The coated amount of the dispersion of the latex is in terms of the coated amount of the solid content of latex.

TABLE 8

Constitution of Support

| Name of layer | Composition | Film thickness (μm) |
|---|---|---|
| Surface undercoat layer | Gelatin | 0.1 |
| Surface PE layer (Glossy) | Low-density polyethylene (Density 0.923): 90.2 parts<br>Surface-processed titanium oxide: 9.8 parts<br>Ultramarine: 0.001 parts | 36.0 |
| Pulp layer | Fine quality paper (LBKP/NBSP = 6/4, Density 1.053) | 152.0 |
| Back-surface PE layer (Matte) | High-density polyethylene (Density 0.955) | 27.0 |
| Back-surface undercoat layer | Styrene/acrylate copolymer<br>Colloidal silica<br>Polystyrenesulfonic acid sodium salt | 0.1 |
| | | 215.2 |

TABLE 8-continued

Constitution of Support

| Name of layer | Composition | Film thickness (μm) |
|---|---|---|

Anionic surfactant (1)

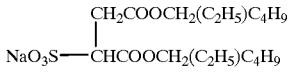

Anionic surfactant (2)

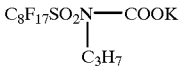

Anionic surfactant (3)

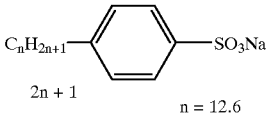

2n + 1 n = 12.6

Anionic surfactant (4)

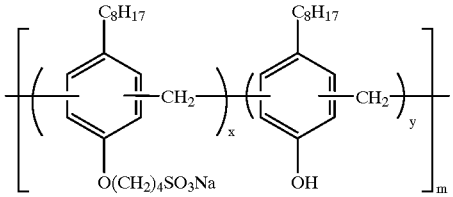

x:y = 4:6 m = 6.8

Nonionic surfactant

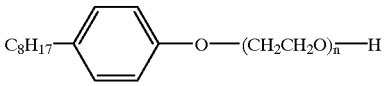

n = 85

Amphoteric surfactant (1)

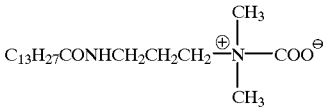

Anti-fading agent (1)

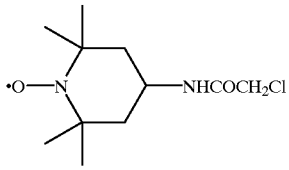

Brightening agent

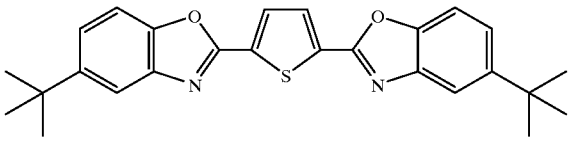

TABLE 8-continued

| Constitution of Support | | |
|---|---|---|
| Name of layer | Composition | Film thickness (μm) |
| Mordant (1) | 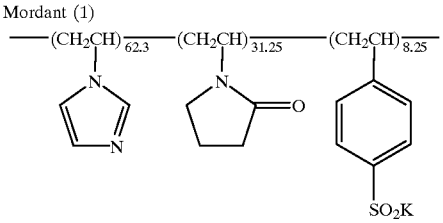 | |
| Stain-preventing agent (1) | 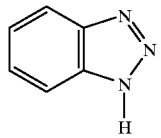 | |
| Stain-preventing agent (2) | 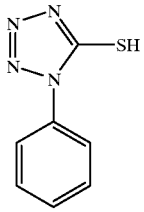 | |
| Stain-preventing agent (3) | 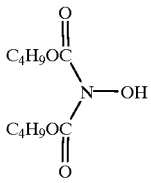 | |
| High-boiling organic solvent (1) | | |
| $C_{28}H_{46.9}Cl_{7.1}$ | | |
| (EMPARA 40, trade name: manufactured by Ajinomoto K.K.) | | |
| Water-soluble polymer (5) | | |
| SUMIKAGEL L5-H | | |
| (trade name: manufactured by Sumitomo Kagaku Co.) | | |
| Water-soluble polymer (2) | | |
| Dextran (molecular weight 70,000) | | |
| Water-soluble polymer (3) | | |
| κ(kappa)-Carrageenan | | |
| (trade name: manufactured by Taito Co.) | | |
| Water-soluble polymer (4) | | |
| MP POLYMER MP-102 | | |
| (trade name: manufactured by Kuraray Co.) | | |
| Dispersion of latex (1) | | |
| LX-438 | | |
| (trade name: manufactured by Nippon Zeon Co.) | | |
| Matting agent (1) | | |
| SYLOID79 | | |
| (trade name: manufactured by Fuji Davisson Kagaku Co.) | | |
| Matting agent (2) | | |
| PMMA particles (average particle diameter 4 μm) | | |
| Hardener (1) | 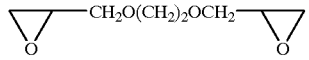 | |

Method for the production of a light-sensitive silver halide emulsion (4) (for a green-sensitive emulsion layer)

A monodispersion cubic silver chlorobromide emulsion was obtained in the same manner as in the production of the silver halide emulsion (2), except that 1.5 mg of $(NH_4)_3RhCl_5.H_2O$ in the solution (II) shown in Table 2 was not used.

Method for the production of a light-sensitive silver halide emulsion (5) (for a green-sensitive emulsion layer)

A monodispersion cubic silver chlorobromide emulsion was obtained in the same manner as in the production of the silver halide emulsion (2), except that in the solution (II) shown in Table 2, the amount of $K_2IrCl_6$ was altered to 0.2 mg and 0.56 g of a yellow prussiate of potash was used. Method for the production of a light-sensitive silver halide emulsion (6) (for a green-sensitive emulsion layer)

A monodispersion cubic silver chlorobromide emulsion was obtained in the same manner as in the production of the silver halide emulsion (2), except that in the solution (II) shown in Table 2, 0.56 g of a yellow prussiate of potash was used and the amount of $K_2IrCl_6$ was altered to $1\times10^{-10}$ mol/mol Ag. Method for the production of a light-sensitive silver halide emulsion (7) (for a green-sensitive emulsion layer)

A monodispersion cubic silver chlorobromide emulsion was obtained in the same manner as in the production of the silver halide emulsion (2), except that in the solution (II) shown in Table 2, the amount of $K_2IrCl_6$ was altered to $1\times10^{-10}$ mol/mol Ag. Method for the production of a light-sensitive silver halide emulsion (8) (for a green-sensitive emulsion layer)

A monodispersion cubic silver chlorobromide emulsion was obtained in the same manner as in the production of the silver halide emulsion (2), except that in the solution (II) shown in Table 2, $K_2IrCl_6$ was not used and 100 g of the following silver bromide fine particle emulsion (1) was added. Method for the production of silver bromide fine particle emulsion (1)

Solutions (I) and (II) shown in Table 9 were added at the same time, to a well-stirred aqueous gelatin solution (in which 40 g of gelatin, 3 g of potassium bromide and 3.5 ml of acetic acid (100%) were added to 1120 ml of water and which was kept at 40° C.), over 3 minutes and 40 seconds. After 5 minutes, solutions (III) and (IV) shown in Table 9 were added at the same time to the mixture over 2 minutes, while the flow rate of the solution (IV) was controlled such that the silver potential would be 50 mV.

The obtained mixture was washed and desalted (at a pH of 4.1 by using a precipitating agent (a)) using a usual method. Thereafter, 22 g of a gelatin which had been treated using lime, was added to the desalted mixture to be adjusted to pH 6.1 and pAg 7.8. A compound (C) was used as an antiseptic. Thus 630 g of a monodispersion cubic silver bromide fine particle emulsion having a particle size of 0.05 μm was obtained.

TABLE 9

| | Solution (I) | Solution (II) | Solution (III) | Solution (IV) |
|---|---|---|---|---|
| $AgNO_3$ | 35 g | none | 65 g | none |
| KBr | none | 25 g | none | 49 g |
| $K_2IrCl_6$ | none | none | none | 11 mg |
| Water to make | 175 ml | 183 ml | 325 ml | 350 ml |

Light-sensitive materials 102, 103, 104, 105 and 106 were produced in the same manner as in the production of the light-sensitive material 101, except that the silver halide emulsion (2) was altered to the silver halide emulsion (4), (5), (6), (7) or (8), respectively.

Next, the above light-sensitive materials 101 to 106 were exposed to light and subjected to treatment as described below.

As light sources for the exposure, 31 in number of LED multi-beams for every color of blue, green and red were used. Only a 460-nm blue LED, 539-nm green LED, and 650-nm red LED were allowed to emit a light in advance using the above LED exposing apparatus, to set electrically so that each density of yellow, magenta and cyan corresponding to the above LEDs would be 0.7. Then the remainder 30 LEDs of each color were set electrically so that all of them respectively would emit beams with the same quantity of light. The exposure time per one exposure at that time was $5\times10^{-7}$ seconds.

Using a scanning head of those LEDs, electric signals were given to each LED which had been set in advance, to carry out scanning exposure while the light-sensitive material was moved in steps of a length of (multi-exposure head/2) (the exposure was run two times at normal positions and three times at exposure joint portions) in the sub-scanning direction. The exposure was run only in one direction according to exposure pattern. The width of the exposure joint portion in this case was 0.3 mm which was designed to be 6% of the length of the exposure head. Then, water for moistening was supplied to the surface of the emulsion side of the exposed light-sensitive material by using a wire bar. Then the light-sensitive material was overlapped on the image-receiving material R201 such that the film surface was brought into contact with the image-receiving material R201. The resulting product was heated at a thermal developing temperature of 83° C. for 20 seconds. Thereafter the image-receiving material was peeled off from the light-sensitive material, to obtain a 300 DPI image on the image-receiving material.

The results of the above exposure and development are shown in Table 10, which shows the comparisons in each amount of Ir and Fe with which the light-sensitive silver halide emulsion was doped, exposure streaks occurred corresponding to both ends of the multi-beams, and Dmax at the time of full power exposure.

TABLE 10

| | Green-sensitive layer emulsion (Silver chlorobromide containing 42% Br) | | | Exposure streaks (which occurred at the exposure joint portion) evaluated by visual observation | |
|---|---|---|---|---|---|
| Light-sensitive Material No. | Doping metal | Amount of Ir doped mol/mol Ag | Amount of Fe doped mol/mol Ag | | Magenta Dmax |
| 101 (Comparative example) | Rh, Ir | $3\times10^{-7}$ | none | Strong | 2.2 |
| 102 (Comparative example) | Ir | $3\times10^{-7}$ | none | Strong | 2.2 |
| 103 (This invention) | Rh, Ir, Fe | $1\times10^{-8}$ | $4\times10^{-5}$ | Weak | 2.3 |
| 104 (This invention) | Rh, Fe | $1\times10^{-10}$ | $4\times10^{-5}$ | Weak | 2.2 |
| 105 (This invention) | Rh | $1\times10^{-10}$ | none | Weak | 1.8 |
| 106 (This invention) | Rh, Ir | $1\times10^{-7}$ (added as fine particles of silver bromide) | none | Weak | 2.3 |

* The blue- and red-sensitive layer emulsions were not doped with Ir.

As is apparent from the results shown in Table 10, it can be understood that magenta streaks which occurred at the exposure joint portions when the exposure head provided with a plurality of exposure light sources was used, could be thoroughly bettered, by setting the amount of Ir to be added to $1\times10^{-7}$ mol or less based on one mole of the silver halide.

Further, it can be understood that reduction in Dmax associated with reduced amount of Ir could be prevented, by doping with Fe or with Ir localized from the fine particles of silver bromide.

Having described our invention as related to the present embodiments, it is our intention that the invention not be limited by any of the details of the description, unless otherwise specified, but rather be construed broadly within its spirit and scope as set out in the accompanying claims.

What I claim is:

1. An image-forming method using an exposure head having plural beam light sources that correspond to each exposure point and that emit each light with the same wavelength, to subject to exposure a light-sensitive material, which is provided at least with a light-sensitive silver halide emulsion and a binder on a support; with the method comprising:

arranging M sets of the beam light sources of the exposure head in a sub-scanning direction, perpendicular to a main scanning direction, along which the exposure head itself is moved, at predetermined intervals, and allowing said light-sensitive material to move in said sub-scanning direction, in steps of a distance of (the length of the exposure head in the aligned direction)/N ($N\geqq2$), to carry out superposing exposure N times, with an exposure time per exposure being $10^{-3}$ seconds or less, thereby forming M×N pixels per exposure head in every M sets of exposure point, to form an image, wherein the silver halide emulsion of said light-sensitive material contains Ir, in an amount to be added of $10^{-8}$ to $10^{-10}$ mol based on 1 mol of the silver halide, and Fe, in an amount to be added of $10^{-7}$ mol or more, but $10^{-3}$ mol or less, based on 1 mol of the silver halide.

2. The image-forming method according to claim 1, wherein said silver halide emulsion comprises silver chlorobromide, which comprises silver chloride in an amount of 50 mol % or more of the total silver halide, and substantially free from silver iodide, and wherein particles of said silver halide each have a localized phase having silver bromide content of less than 80 mol %, with the localized phase containing at least 50% or more of the total amount of Ir added, when the particles of said silver halide are prepared.

3. The image-forming method according to claim 1, wherein said light-sensitive material is a heat-developable light-sensitive material comprising, on a support, at least three silver halide emulsions different in color sensitivity, a binder, and a developing agent, and a compound that reacts with an oxidized product of the developing agent to form a diffusible dye, or a dye-providing compound.

4. The image-forming method according to claim 1, wherein said light sources for exposure are LEDs each having an emission wavelength ranging from the visible range to the infrared range.

5. The image-forming method according to claim 1, wherein said light sources for exposure are selected from the group consisting of a blue LED, a green LED, and a red LED.

6. The image-forming method according to claim 1, wherein said light sources for exposure are selected from the group consisting of a blue LED having a wavelength range of ±10 nm selected from 430 to 480 nm, a green LED having a wavelength range of ±10 nm selected from 500 to 560 nm, and a red LED having a wavelength range of ±10 nm selected from 640 to 690 nm.

7. The image-forming method according to claim 1, wherein said silver halide emulsion contains at least one metal selected from the group consisting of Co, Ni, Ru, Rh, Pd, Os and Pt, in an amount to be added from about 0 to $10^{-5}$ mol per mol of the silver halide.

8. The image-forming method according to claim 1, wherein said silver halide emulsion contains gold in an amount of $1.0\times10^{-7}$ mol to $1.0\times10^{-4}$ mol, per mol of silver.

9. The image-forming method according to claim 1, wherein said light-sensitive material contains a color-developing agent represented by formula (I):

formula (I)

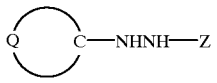

wherein, in formula (I), Z represents a carbamoyl group, an acyl group, an alkoxycarbonyl group, an aryloxycarbonyl group, a sulfonyl group or a sulfamoyl group, and Q represents a group of atoms necessary to form a five- to seven-membered unsaturated ring together with the C.

10. The image-forming method according to claim 1, wherein said light-sensitive material contains a coupler in which the coupling position is substituted with a coupling split-off group other than a hydrogen atom.

* * * * *